US010403082B2

(12) United States Patent
Achmüller et al.

(10) Patent No.: US 10,403,082 B2
(45) Date of Patent: Sep. 3, 2019

(54) SYSTEMS AND METHODS FOR PROVIDING PRIVATE SOUND FROM A WAGERING GAMING MACHINE VIA MODULATED ULTRASOUND

(71) Applicant: IGT Canada Solutions ULC, Moncton (CA)

(72) Inventors: Klaus Achmüller, Graz (AT); Stefan Keilwert, St. Josef (AT)

(73) Assignee: IGT Canada Solutions ULC, Moncton (CA)

( * ) Notice: Subject to any disclaimer, the term of this patent is extended or adjusted under 35 U.S.C. 154(b) by 324 days.

(21) Appl. No.: 15/097,116

(22) Filed: Apr. 12, 2016

(65) Prior Publication Data

US 2017/0294072 A1 Oct. 12, 2017

(51) Int. Cl.
*G07F 17/32* (2006.01)

(52) U.S. Cl.
CPC ..... *G07F 17/3204* (2013.01); *G07F 17/3206* (2013.01); *G07F 17/3225* (2013.01)

(58) Field of Classification Search
CPC ..... G07F 17/3204; G07F 17/3225
See application file for complete search history.

(56) References Cited

U.S. PATENT DOCUMENTS 6,584,205 B1 * 6/2003 Croft, III ..... H04R 3/00 381/103
8,172,677 B2 5/2012 Bleich et al.
8,184,824 B2 * 5/2012 Hettinger ..... G07F 17/32 381/302
8,622,830 B2 1/2014 Radek
8,740,701 B2 6/2014 Berry et al.
8,934,650 B1 * 1/2015 Norris ..... H04R 17/00 381/173
9,005,023 B2 4/2015 Bonney et al.
9,258,651 B2 2/2016 Norris et al.
2002/0132663 A1 * 9/2002 Cumbers ..... G06K 9/00288 463/25
2003/0035552 A1 * 2/2003 Kolano ..... G10K 11/28 381/77
2003/0064804 A1 * 4/2003 Wilder ..... G07F 17/32 463/35
2003/0185405 A1 * 10/2003 Spencer ..... H04R 3/00 381/77

(Continued)

*Primary Examiner* — Corbett B Coburn
(74) *Attorney, Agent, or Firm* — Sage Patent Group

(57) ABSTRACT

An electronic wagering gaming machine system includes a display, one or more input controls, one or more ultrasound emitters and a sensor that detects the location of a person in proximity to the display. Control circuitry executes wagering game software that receives input commands entered via the input control(s), to display graphics output from the wagering game software responsive to the input commands, and to generate public and private sound signals in an audible frequency range. The private sound signals may be directed to the detected person's location by modulating one or more ultrasound carrier waves with the private sound signals and outputting the modulated ultrasound waves toward the detected person's location via the ultrasound emitter(s). The public sound signals may be played in the audible frequency range via the audio speaker(s).

20 Claims, 12 Drawing Sheets

(56) References Cited

U.S. PATENT DOCUMENTS

2005/0185800 A1* 8/2005 Croft, III ..... H04R 3/00 381/77
2005/0195985 A1* 9/2005 Croft, III ..... H04R 17/00 381/77
2005/0282631 A1* 12/2005 Bonney ..... G07F 17/32 463/35
2006/0199645 A1* 9/2006 Canterbury ..... G07F 17/32 463/43
2007/0036368 A1* 2/2007 Hettinger ..... G07F 17/32 381/107
2007/0121970 A1* 5/2007 Miyazaki ..... H04R 3/06 381/116
2010/0298051 A1* 11/2010 Loose ..... G07F 17/32 463/35
2011/0109134 A1* 5/2011 Filipour ..... A47C 7/72 297/217.4
2012/0322542 A1* 12/2012 Chudd ..... G07F 17/3206 463/25
2015/0104046 A1 4/2015 Norris
2015/0110286 A1* 4/2015 Norris ..... G10K 11/346 381/77
2015/0117657 A1* 4/2015 Anazawa ..... H04R 3/12 381/71.1
2015/0139439 A1* 5/2015 Norris ..... H04R 1/323 381/77
2015/0304789 A1* 10/2015 Babayoff ..... H04R 1/403 381/303
2016/0014529 A1* 1/2016 Hecht ..... G06F 1/16 381/388
2016/0180644 A1* 6/2016 Idris ..... G07F 17/3225 463/20
2016/0373864 A1* 12/2016 Hecht ..... G06F 1/1688
2017/0289684 A1* 10/2017 Chang ..... H04R 3/14

* cited by examiner

SYSTEMS AND METHODS FOR PROVIDING PRIVATE SOUND FROM A WAGERING GAMING MACHINE VIA MODULATED ULTRASOUND

BACKGROUND

Modern casinos are increasingly moving toward electronic and computerized implementations for their gaming machines. For example, slot machines historically were mechanical devices whose physical reels could be spun by pulling a lever on the side of the machine. Each symbol on each reel occupied a physical stop having the same probability of occurrence as all other stops on the reel, and the machine would pay out based on the combination of symbols appearing in a line across the reels (the "payline") when all of the reels stopped spinning. Today, however, mechanical reels in slot machines are typically controlled electronically, such that different payline probabilities can be assigned to different symbols on the reels. The reels can be spun by pushing a button that activates the electronic control, although some machines may retain the traditional lever for entertainment value. In newer video slot machines, the physical reels are replaced by virtual reels whose symbols are displayed on a video screen, controlled by one or more computer processors. Some video slot machines have physical buttons for the player to press, while others are operated via touchscreen.

An electronic gaming machine thus typically uses electronically generated images and sounds to create an entertainment experience for a player. Visual images of the reels, for example, are created electronically and displayed for the player to visually experience the spinning of the reels, the symbols landing on the payline, various entertaining animations triggered by wins, losses, and other events, animated bonus games and other entertaining visual depictions, etc. Electronic gaming machines also often output electronically generated sound as part of the entertainment experience. Audio speakers on the electronic gaming machine may play, for example, sounds simulating the sounds of the physical levers and reels of old fashioned slot machines, music tracks accompanying and enhancing the entertainment experience of the games, sound effects that enhance visual animations, etc. These various electronic devices are used to create an engaging and entertaining experience for the player of the electronic gaming machine.

SUMMARY

One type of embodiment is directed to an electronic gaming machine system comprising a display; one or more input controls; one or more audio speakers; one or more ultrasound emitters; at least one sensor configured to detect a location of a person in proximity to the display; and control circuitry configured to: execute wagering game software that receives input commands entered via the one or more input controls; display graphics output from the wagering game software responsive to the input commands; generate one or more private sound signals in an audible frequency range, and one or more public sound signals in the audible frequency range; direct the one or more private sound signals to the detected person's location by modulating one or more ultrasound carrier waves with the one or more private sound signals and outputting the modulated ultrasound waves toward the detected person's location via the one or more ultrasound emitters; and play the one or more public sound signals in the audible frequency range via the one or more audio speakers.

Another type of embodiment is directed to a method comprising: detecting, using one or more sensors of an electronic gaming machine system, a location of a person in proximity to a display of the electronic gaming machine system; executing wagering game software that receives user input commands entered via one or more input controls of the electronic gaming machine system; displaying, on the display of the electronic gaming machine system, graphics output from the wagering game software responsive to the input commands; generating, via control circuitry of the electronic gaming machine system, one or more private sound signals in an audible frequency range, and one or more public sound signals in the audible frequency range; directing the one or more private sound signals to the detected person's location by modulating one or more ultrasound carrier waves with the one or more private sound signals and outputting the modulated ultrasound waves toward the detected person's location via one or more ultrasound emitters of the electronic gaming machine system; and playing the one or more public sound signals in the audible frequency range via one or more audio speakers of the electronic gaming machine system.

Another type of embodiment is directed to an electronic gaming machine system comprising a display; one or more input controls; one or more ultrasound emitters; at least one sensor configured to detect a location of a person in proximity to the display; and control circuitry configured to: execute wagering game software that receives input commands entered via the one or more input controls; display graphics output from the wagering game software responsive to the input commands; generate one or more private sound signals in an audible frequency range; direct the one or more private sound signals to the detected person's location by modulating one or more ultrasound carrier waves with the one or more private sound signals and outputting the modulated ultrasound waves toward the detected person's location via the one or more ultrasound emitters.

Another type of embodiment is directed to an audio content delivery system comprising a plurality of ultrasound emitters, including one or more left-ear ultrasound emitters and one or more right-ear ultrasound emitters; at least one sensor configured to detect a location of a person's left ear and a location of the person's right ear; and control circuitry configured to: access a stereophonic audio signal having at least a left-ear component signal and a right-ear component signal in an audible frequency range; direct the left-ear component of the stereophonic audio signal to the detected location of the person's left ear by modulating one or more left-ear ultrasound carrier waves with the left-ear component of the stereophonic audio signal and outputting the modulated left-ear ultrasound waves toward the detected location of the person's left ear via the one or more left-ear ultrasound emitters; and direct the right-ear component of the stereophonic audio signal to the detected location of the person's right ear by modulating one or more right-ear ultrasound carrier waves with the right-ear component of the stereophonic audio signal and outputting the modulated right-ear ultrasound waves toward the detected location of the person's right ear via the one or more right-ear ultrasound emitters.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
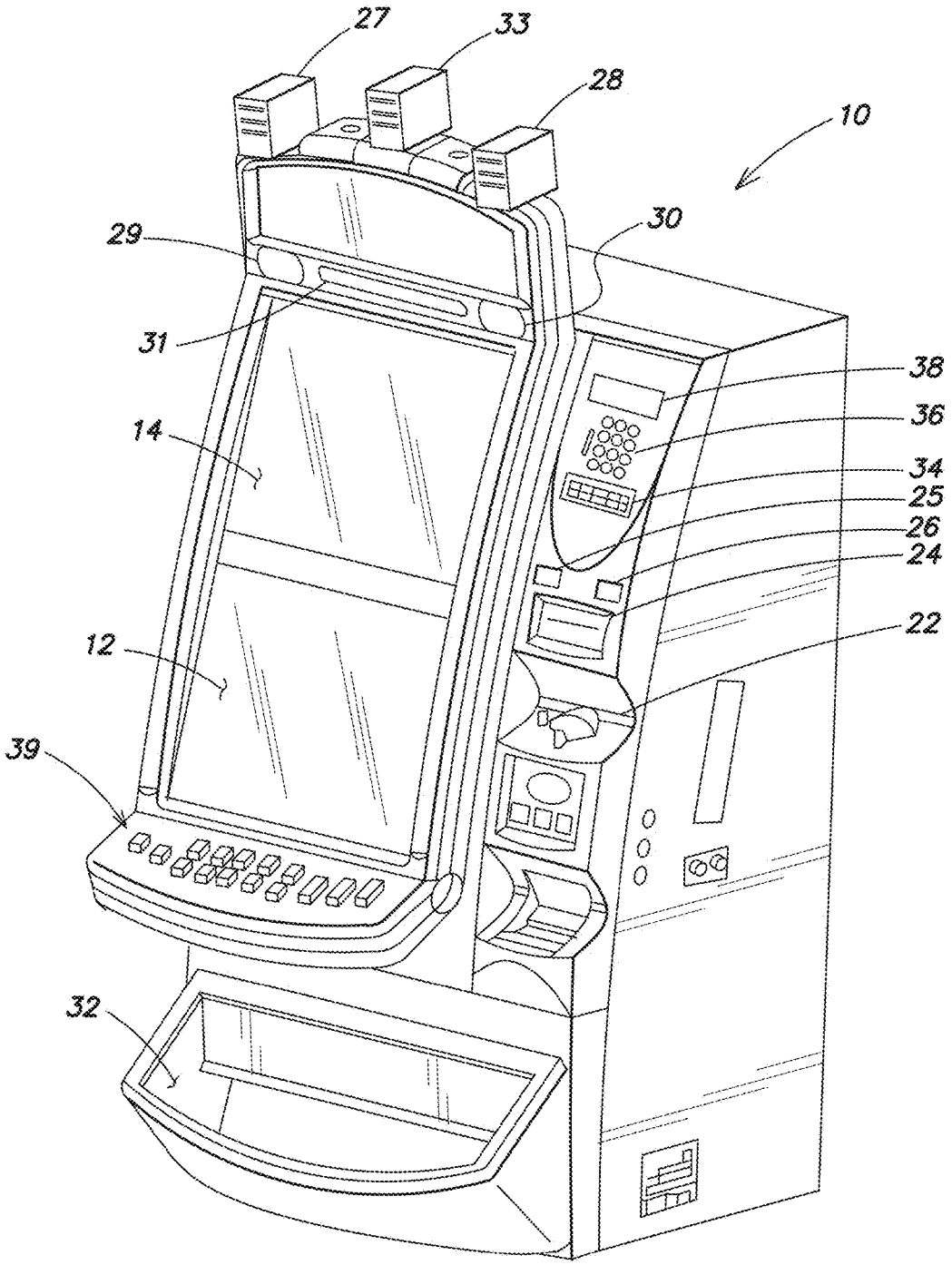
FIG. 1 is a perspective view of an exemplary cabinet housing an electronic gaming machine in accordance with some embodiments.

The inventors have recognized that, while the sounds generated by an electronic gaming machine are typically designed to enhance the wagering gaming experience and to make the game play more engaging and enjoyable for the player, the noises generated by electronic gaming machines can also at times be an annoyance or detraction. For example, in a casino venue, there are often multiple electronic gaming machines (e.g., several hundred, in large casinos) located in close proximity to each other and to other gaming areas on the casino floor. For a person playing a game on one electronic gaming machine, it may be distracting and annoying to hear too many sounds coming from other nearby electronic gaming machines while the person is trying to focus on his own game. The inventors have recognized as well that people pursuing other types of activities within the venue—the serious players of a high-stakes game at the nearby poker tables, for instance—may find the constant cacophony of overlapping sound effects from a neighboring bank of electronic gaming machines bothersome. Also, in some locales electronic gaming machines may be installed in non-casino venues, such as bars, lounges, restaurants, airports, stores, etc., where the typical sounds and sound levels from casino electronic gaming machines may be less appreciated by the establishment's regular customers.

The inventors have further recognized that not all electronic gaming machine sounds are necessarily created equal. The inventors have appreciated that some types of electronic gaming machine sounds may be more of an annoyance to people in the surrounding environment than others, and that while some types of sounds may only be of real benefit for the person at a particular machine to hear, other types of sounds may actually be desirable for broadcasting to anyone in the vicinity of the machine. For example, the inventors have appreciated that sound effects indicating that a player has won a game (e.g., jackpot sounds) may be beneficial for broadcasting for people nearby to hear, because such win acknowledgment sounds can convey the impression that the game is being won easily or often, which may attract more people to play. On the other hand, the inventors have recognized that other types of sounds, such as sound effects accompanying a loss, may be less desirable for people nearby to hear, as hearing them may discourage other people from playing. The inventors have recognized that yet other types of sounds may simply tend to contribute to bothersome background noise without being of any desirable benefit for being heard by people nearby. For example, some electronic gaming machines may play recorded instructions to tell a player what to do and how to play a game, or may read available menu items to a player, or audibly inform a player of information such as his current score, account balance, etc. The inventors have appreciated that such verbal information may often be of little use to be heard by people other than the player of a particular electronic gaming machine, and may contribute to undesirable noise. As another example, the inventors have recognized that an electronic gaming machine in "attract mode" may output a recorded prompt to a person immediately nearby the machine in an attempt to attract that person to play a wagering game on the machine, but the noise created by multiple electronic gaming machines repeating recorded "attract mode" prompts every time a person walks by any of the machines can become irritating.

In view of the foregoing, the inventors have developed techniques to improve the experience associated with an electronic gaming machine by making certain sounds audible only to the person using that electronic gaming machine. In some embodiments, such private sounds may be provided using modulated ultrasound. Accordingly, an electronic gaming machine system in some embodiments may comprise one or more ultrasound emitters configured to emit ultrasound carrier waves, having frequencies that are above the audible frequency range. For example, the ultrasound emitter(s) may emit carrier waves with frequencies greater than 20 KHz. In some embodiments, an ultrasound carrier wave may be modulated with a sound signal that is designated to be private (i.e., for only one person or a particular group of persons to hear, such as only the person or persons occupying a particular location zone near the electronic gaming machine system). The inventors have appreciated that because ultrasound waves are higher in frequency than audible sound waves, the former are generally more directional (i.e., have less angular divergence) than the latter. As a reflection of their directional propagation characteristics, ultrasound waves are also referred to herein as "ultrasound beams." The inventors have appreciated that an ultrasound carrier wave may be modulated with a sound signal in an audible frequency range, such that a listener's ear may perceive the audible sound signal, e.g., by responding to the envelope of the modulated carrier wave. Due to the directionality of the ultrasound beam, the sound signal used to modulate the ultrasound carrier wave may only be perceptible to a person positioned at a particular location to which the beam is directed, thus keeping the sound signal private to the person at that location and imperceptible to other people at other locations outside of the path of the ultrasound beam. In some embodiments, one or more modulated ultrasound carrier waves may thus be used to direct one or more private sound signals to a person at the electronic gaming machine system, such as any of the sounds discussed above that may not be desirable for other people in the neighboring environment to hear.

In some embodiments, a modulated ultrasound beam may direct private sounds of an electronic gaming machine system to a static location in proximity to the electronic gaming machine system, and a player may place himself in that "sweet spot" to be in the path of the ultrasound beam and hear the private sounds it conveys. Alternatively or additionally, in some embodiments, an electronic gaming machine system may detect the location of a person in proximity, and may direct one or more private sound signals to that location. Thus, in some embodiments, the electronic gaming machine system may further comprise one or more sensors configured to detect the location of a person in proximity to the electronic gaming machine system. The system may output the modulated ultrasound waves toward the detected person's location via the ultrasound emitter(s) to direct the private sound signal(s) to the person.

In some embodiments, an electronic gaming machine system may comprise one or more audio speakers in addition to the ultrasound emitter(s). As described above, while the ultrasound emitters may be used to provide private sounds, the audio speakers may be used to play public sounds hearable by anyone in the vicinity of the electronic gaming machine system, in some embodiments. Such public sounds may include, for example, win acknowledgment sounds such as jackpot sounds, which may be desirable for people other than the current player of the electronic gaming machine system to hear. Accordingly, the audio speakers may play these public sounds directly as sound waves in the audible frequency range, in which the sound waves are less directional than the ultrasound beams emitted by the ultrasound emitters.

The inventors have further developed techniques for using modulated ultrasound in an audio content delivery system configured to deliver stereophonic sound without headphones. In stereophonic sound, one audio signal is provided to the listener's left ear and another audio signal is provided to the listener's right ear. Conventionally, these signals are provided to the two different ears using headphones. While the signals provided to the two ears can be the same, they can also be made to differ to create sound localization perceptions. For example, a particular sound can be provided to only one ear, causing that sound to be perceived as if it had come from the direction of that ear. More complex signal processing techniques (examples of which are known) can also be applied to generate a left-ear signal and a right-ear signal that, when heard together, exploit the brain's use of information such as timing and amplitude differences between sounds heard at the two ears to create the perception of sounds being localized anywhere in a 2D or 3D space around the listener as desired.

The inventors have appreciated that, using modulated ultrasound carrier waves, stereophonic sound signals may be provided privately to the ears of a particular listener, without need for physical devices at the ears such as headphones. This may be beneficial, for example, where a listener may not have access to headphones, or may find the use of headphones to be cumbersome. In some embodiments, such an audio content delivery system may comprise one or more left-ear ultrasound emitters and one or more right-ear ultrasound emitters, for directing the left-ear component of a stereophonic audio signal to the listener's left ear and the right-ear component of the stereophonic audio signal to the listener's right ear. In some embodiments, the audio content delivery system may include one or more sensors configured to detect the location of the person's left and right ears, so that the respective modulated ultrasound carrier waves can be directed to the detected locations. In some embodiments, the ultrasound beams may be configured to minimize crosstalk, such that the left ear hears only the left-ear component of the stereophonic audio signal carried by the left-ear ultrasound carrier waves, and the right ear hears only the right-ear component of the stereophonic audio signal carried by the right-ear ultrasound carrier waves. In some embodiments, such a stereophonic ultrasound private audio delivery system may be used in an electronic gaming machine system. However, it should be appreciated that this is merely one example, and not all embodiments are so limited. Techniques described herein for providing stereophonic audio via modulated ultrasound may be used in any type of audio content delivery system, such as wagering gaming systems, non-wagering gaming systems, music players, televisions, video players, cinemas, virtual reality simulators, etc.

It should be appreciated that the foregoing description is by way of example only, and embodiments are not limited to providing any or all of the above-described functionality, although some embodiments may provide some or all of the functionality described herein. Moreover, various embodiments are not limited to providing any of the benefits discussed above, and it should be appreciated that some embodiments may not provide any of the above-discussed benefits and/or may not address any of the above-discussed deficiencies that the inventors have recognized in conventional techniques.

The embodiments described herein can be implemented in any of numerous ways, and are not limited to any particular implementation techniques. Thus, while examples of specific implementation techniques are described below, it should be appreciated that the examples are provided merely for purposes of illustration, and that other implementations are possible.

Illustrative applications for some of the techniques described herein are for use in a system for providing wagering game play in a casino venue, in a lottery terminal, in a mobile gaming system, or in any other type of gaming environment. However, such techniques are not limited to these applications. In some embodiments, wagering game play may be provided via an electronic gaming machine configured to output any of various types of audio effects. Some audio effects may be output during a wagering game, while other audio effects may be output when no game is being played (e.g., in attract mode).

An exemplary cabinet 10 housing an electronic gaming machine is illustrated in perspective view in FIG. 1. It should be appreciated that the configuration of electronic gaming machine cabinet 10 is merely one example configuration provided for purposes of illustration, and embodiments are not limited to the particular configuration illustrated in FIG. 1. Other exemplary embodiments of an electronic gaming machine cabinet may not include all of the components illustrated in exemplary electronic gaming machine cabinet 10, and/or may include additional components not shown in FIG. 1, and/or may include similar components arranged differently than illustrated in FIG. 1.

Exemplary cabinet 10 includes a display 12 that may be a thin film transistor (TFT) display, a liquid crystal display (LCD), a cathode ray tube (CRT) display, a light-emitting diode (LED) display, an organic LED (OLED) display, an autostereoscopic three dimensional (3D) display, or any other type of display. A second display 14 may provide game data or other information in addition to display 12. Display 14 may provide static information, such as an advertisement for the game, the rules of the game, pay tables, pay lines, and/or other information, and/or may even display the main game or a bonus game along with display 12. Alternatively, the area for display 14 may be a display glass for conveying information about the game. Display 12 may also include a camera (e.g., behind the display screen) for use, for example, in presenting an autostereoscopic 3D display.

Display 12 and/or display 14 may have a touch screen lamination that includes a transparent grid of conductors. A player touching the screen may change the capacitance between the conductors, and thereby the X-Y location of the touch on the screen may be determined. A processor within cabinet 10 may associate this X-Y location with a function to be performed. There may be an upper and lower multi-touch screen in accordance with some embodiments.

A coin slot 22 may accept coins or tokens in one or more denominations to generate credits within the casino electronic gaming machine for playing games. An input slot 24 for an optical reader and printer may receive machine readable printed tickets and may output printed tickets for use in cashless gaming.

A coin tray 32 may receive coins or tokens from a hopper (not shown) upon a win or upon the player cashing out. However, in some embodiments, the casino electronic gaming machine may not pay in cash, but may only issue a printed ticket for cashing in elsewhere. Alternatively, a stored value card may be loaded with credits based on a win, or may enable the assignment of credits to an account associated with a computer system, which may be a computer network-connected computer.

A card reader slot 34 may accept any of various types of cards, such as smart cards, magnetic strip cards, and/or other types of cards conveying machine readable information. The card reader may read the inserted card for player and/or credit information for cashless gaming. The card reader may read a magnetic code on a player tracking card, where the code uniquely identifies the player to the casino venue's host system. The code may be cross-referenced by the host system to any data related to the player, and such data may affect the games offered to the player by the casino venue. The card reader may also include an optical reader and printer for reading and printing coded barcodes and other information on a paper ticket. A card may also include credentials that enable the host system to access one or more accounts associated with a user. The account may be debited based on wagers by a user and credited based on a win.

A keypad 36 may accept player input, such as a personal identification number (PIN) and/or any other player information. A display 38 above keypad 36 may display a menu for instructions and/or other information, and/or may provide visual feedback of the keys pressed. The keypad 36 may be an input device such as a touchscreen, or dynamic digital button panel, in accordance with some embodiments.

Player control buttons 39 may include any buttons and/or other controllers usable for the play of the particular game or games offered via the casino electronic gaming machine cabinet, including, for example, a bet button, a repeat bet button, a spin reels (or play) button, a maximum bet button, a cash-out button, a display pay lines button, a display payout tables button, select icon buttons, and/or any other suitable button(s). In some embodiments, buttons 39 may be replaced by a touchscreen with virtual buttons. In some embodiments, touchless control gesture functionality may replace or coexist with buttons 39.

Cabinet 10 may include one or more audio speakers, in some embodiments, such as audio speakers 27 and 28 attached to or otherwise integrated with cabinet 10 in FIG. 1. In other embodiments, audio speakers may be part of the same electronic gaming machine system as cabinet 10 and controlled by the electronic gaming machine, but may be separate structures from cabinet 10, e.g., next to cabinet 10. Audio speakers 27 and 28 may be configured to play sound signals in an audible frequency range. The audible frequency range covered by audio speakers 27 and 28 may be any suitable set of frequencies perceptible as sound to the human ear. For example, in some embodiments, the upper frequency limit of audio speakers 27 and 28 may be around 20 KHz, which is generally accepted as about the highest frequency audible to the human ear. In some embodiments, the lower frequency limit of audio speakers 27 and 28 may be around 20 Hz, which is generally accepted as about the lowest frequency audible to the human ear. However, any suitable audible frequency range may be used, as embodiments are not limited in this respect. In some embodiments, audio speakers 27 and 28 may be configured to output sound only in a subset of the audible frequencies, and any suitable subset may be chosen.

In some embodiments, electronic gaming machine cabinet 10 may include one or more ultrasound emitters, such as exemplary ultrasound emitters 29, 30 and 31 as illustrated in FIG. 1. These are illustrated merely as examples, however, as cabinet 10 may comprise any suitable number and/or configuration of ultrasound emitters. The ultrasound emitter(s) may be disposed in any suitable location on cabinet 10. Alternatively or additionally, in some embodiments one or more ultrasound emitters may be separate from cabinet 10 as part of an electronic gaming machine system including adjacent structures. The ultrasound emitters may be configured, in some embodiments, to emit ultrasound carrier waves having frequencies above the audible frequency range (e.g., above 20 KHz). Any suitable ultrasound frequency range may be used. In some embodiments, a particular ultrasound carrier frequency may be selected (e.g., about 40 KHz, or any other suitably selected ultrasound carrier frequency) as appropriate for the design considerations of a particular electronic gaming machine system.

The ultrasound emitters may comprise one or more electrostatic ultrasound speakers in some embodiments. Alternatively or additionally, in some embodiments the ultrasound emitters may comprise one or more arrays of ultrasound transducers. In one example, ultrasound emitter 31 may comprise a linear array of transducers such that it can emit ultrasound waves through a sub-portion of the emitter surface by driving only certain transducers along the array at different times. This is one way, in some embodiments, that ultrasound signals may be directed to different positions by the electronic gaming machine system in a controllable fashion, as described further below. For instance, in the example of horizontal ultrasound array emitter 31, the location to which the emitted ultrasound waves are directed may be varied horizontally, e.g., to match the player's horizontal movement (weight shifting, etc.) in front of cabinet 10.

To detect and/or track the location of a person (e.g., a player) in proximity to the electronic gaming machine system, exemplary cabinet 10 may comprise one or more sensors, in some embodiments. Any suitable number, type(s), and/or configuration of sensor(s) may be used for this purpose. For example, one suitable type of sensor may be a camera that may detect the location of a person by capturing an image showing the person in that location in proximity to cabinet 10. The image may be processed, for example, by one or more processors of the electronic gaming machine system to determine the person's location based on the captured image data. In some embodiments, the camera may be the same camera described above in connection with display 12 for player tracking in presenting an autostereoscopic display. Alternatively or additionally, some embodiments may use a different and/or separate camera 25, and some embodiments may not include an autostereoscopic display camera but may include a camera 25 for detecting a person in proximity for sound beaming. In some embodiments, alternatively or additionally, cabinet 10 may comprise one or more sensors of any other suitable type configured to detect the location of a person. Another example of a suitable sensor is ultrasound sensor 26, which may detect the location of a person by detecting an ultrasound wave emitted by the machine and reflected by the person. While camera 25 and other sensor 26 are disposed on a front panel of cabinet 10 in the example illustrated in FIG. 1, this is not required, and any such sensors may be disposed in any other suitable location on or around cabinet 10 in some embodiments.

In some embodiments, cabinet 10 may further comprise one or more audio sensors, such as exemplary audio sensor 33 illustrated in FIG. 1. Audio sensor 33 may be configured to detect background noise in some embodiments, and this information may be used to adjust the loudness of the private sounds delivered by modulated ultrasound. For example, in some embodiments, control circuitry in cabinet 10 may be configured to adjust the amplitude of the output modulated ultrasound waves based at least in part on the level of background noise detected via the audio sensor(s). The amplitude of the modulated ultrasound (e.g., average amplitude, maximum amplitude, average intensity level, etc.) may be increased when the level of background noise increases, for example, to make the private sound signals audible over the background noise to the person in the path of the ultrasound beam. The ultrasound waves may be decreased in amplitude when the background noise level decreases, in some embodiments, so that the private sounds do not seem unnecessarily loud to the person in the path of the ultrasound beam.

Figure 2:
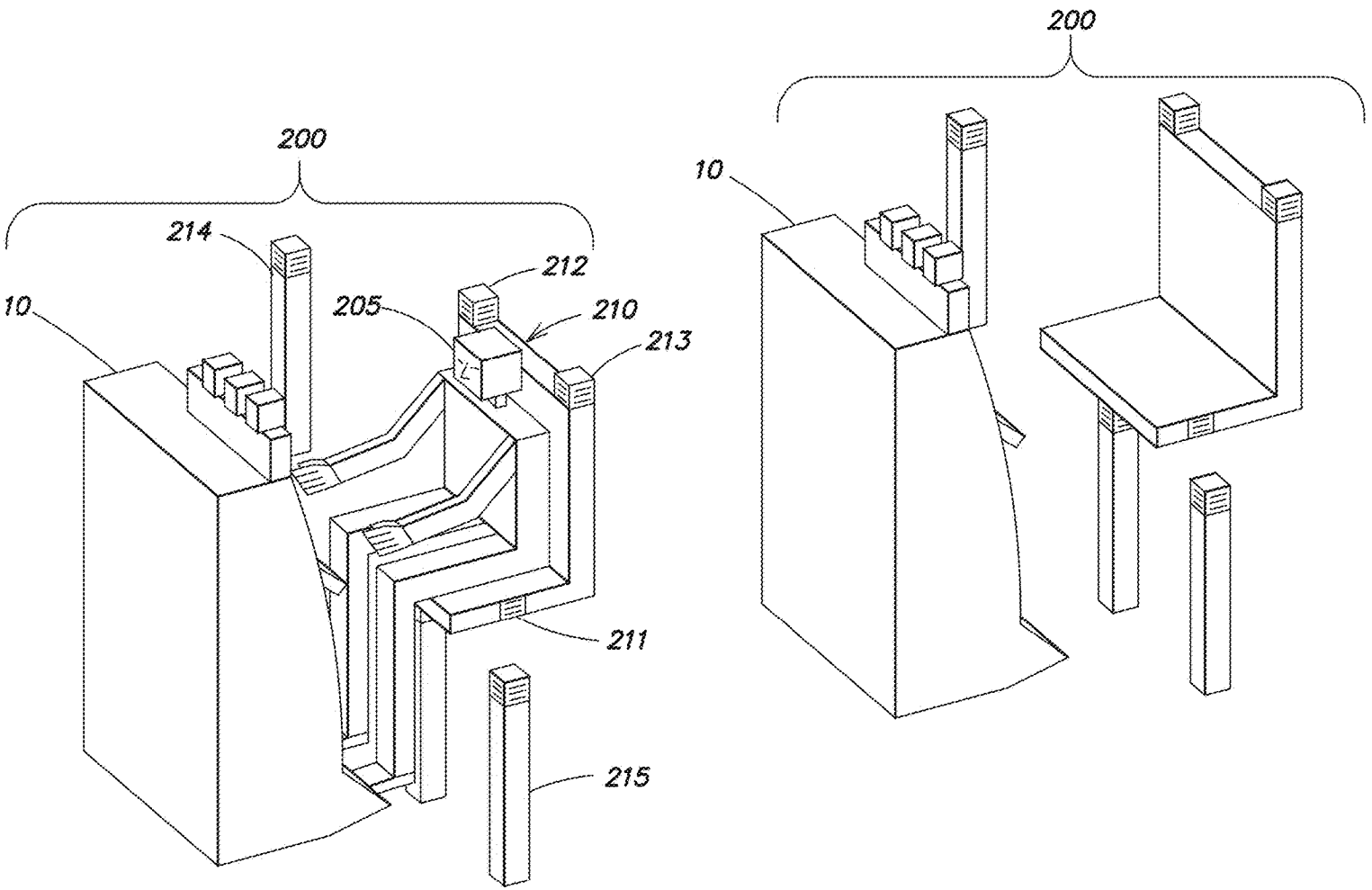
FIG. 2 illustrates an exemplary wagering gaming environment of electronic gaming machine systems in accordance with some embodiments.

In some embodiments, cabinet 10 may be part of a larger electronic gaming machine system. In addition to the cabinet, the electronic gaming machine system may further comprise a seat, and/or any other suitable additional apparatus contributing to the gaming experience for a game played on the electronic gaming machine. FIG. 2 illustrates an environment including two exemplary such electronic gaming machine systems 200, according to a non-limiting embodiment. It should be appreciated that the configuration of electronic gaming machine system 200 shown in FIG. 2 is merely one example configuration provided for purposes of illustration, and embodiments are not limited to the particular configuration illustrated in FIG. 2. Other exemplary embodiments of an electronic gaming machine system may not include all of the components illustrated in exemplary electronic gaming machine system 200, and/or may include additional components not shown in FIG. 2, and/or may include similar components arranged differently than illustrated in FIG. 2.

Exemplary electronic gaming machine system 200 includes cabinet 10 and seat 210 positioned in front of cabinet 10. Seat 210 may be used by a player, such as player 205, to sit within reach of cabinet 10, e.g., to play a wagering game on cabinet 10. Seat 210 may comprise a chair, a bench, a stool, or any other suitable apparatus on which a person can sit. While in the example of FIG. 2 electronic gaming machine system 200 comprises one seat, electronic gaming machine system 200 may alternatively comprise any other suitable number of seats. For example, some wagering games may be playable in multi-player mode in some embodiments. In some such embodiments, electronic gaming machine system 200 may comprise multiple seats, such as a number of seats equal to the maximum number of players allowed in the game, or may have a large seat such as a long bench that can accommodate multiple players, etc.

In some embodiments, seat 210 may comprise, or may be connected to, one or more devices configured to create the perception of sound for the player 205 sitting in the seat 210. For example, in some embodiments, seat 210 may have one or more devices configured to generate longitudinal waves in the air that will vibrate a listener's ear drum, such as exemplary wave emitting devices 212 and 213. Wave emitting devices 212 and 213 may comprise audio speakers (generating sound waves at audible frequencies) and/or ultrasound emitters (generating ultrasound carrier waves). In some embodiments, emitting devices 212 and 213 may be disposed on a backrest of seat 210, or on any other suitable location on seat 210.

As another example of a device to create the perception of sound, in some embodiments seat 210 may comprise, or may be connected to, one or more low-frequency vibration-generating devices, such as low-frequency vibration-generating device 211. In some embodiments, low-frequency vibration-generating device 211 may be configured to output one or more low-frequency signals by vibrating the seat 210. For example, low-frequency vibration-generating device 211 may output signal(s) having frequencies that are less than 1 KHz in some embodiments, less than 500 Hz in some embodiments, less than 250 Hz in some embodiments, in any other suitable low-frequency range. The signal(s) output by low-frequency vibration-generating device 211 may be perceived as sound by the ears of player 205, e.g., by bone conductance. The inventors have appreciated that such a low-frequency vibration-generating device 211 provides another way in which private sounds can be delivered only to player 205 who is sitting on seat 210. In some embodiments, one or more such vibration-generating devices may be used in conjunction with one or more ultrasound emitters to provide a wider combined frequency range of private sounds to player 205. For example, in some embodiments, the ultrasound carrier waves may be modulated with private sound signals that do not extend below a suitable threshold audible frequency (e.g., 250 Hz in some embodiments, or any other suitable low-frequency threshold), and private sounds in the low-frequency range below that threshold may be filled in as vibration signals.

Alternatively or additionally to devices installed at seat 210, in some embodiments electronic gaming machine system 200 may comprise one or more wave emitting devices separate from seat 210, such as exemplary wave emitting devices 214 and 215. These devices 214 and 215 similarly may comprise audio speakers and/or ultrasound emitters. In some embodiments, emitting devices 214 and 215 may be disposed on the floor near cabinet 10, or hung from the ceiling near cabinet 10, or attached or integrated into any other suitable structure in proximity to cabinet 10. In some embodiments, at least one emitting device 214 may be disposed to the right of player 205 and at least one emitting device 215 may be disposed to the left of player 205.

In some embodiments, electronic gaming machine system 200 may comprise a game controller board configured to control operations of the system before, during and/or after the execution of a wagering game. The game controller board may be disposed in cabinet 10, in some embodiments, or may be located more remotely and provide control signals to cabinet 10 and/or other structures of electronic gaming machine system 200. The game controller board may include control circuitry, which may include one or more (micro)processors, in some embodiments. As discussed further below, in some embodiments the game controller board may be configured to determine whether a sound is to be played publicly or privately. Accordingly, in some embodiments the game controller board may consequently cause one or more audio speakers of electronic gaming machine system 200 to play a sound determined to be public, may cause one or more ultrasound emitters of electronic gaming machine system 200 to emit an ultrasound beam modulated by a sound determined to be private, and/or may cause one or more low-frequency vibration devices to generate a low-frequency vibration signal corresponding to a sound determined to be private and extending below the low-frequency threshold of the modulated ultrasound. Electronic gaming machine system 200 may be implemented using one or more computers; an example of a suitable computer is described below.

Figure 3:
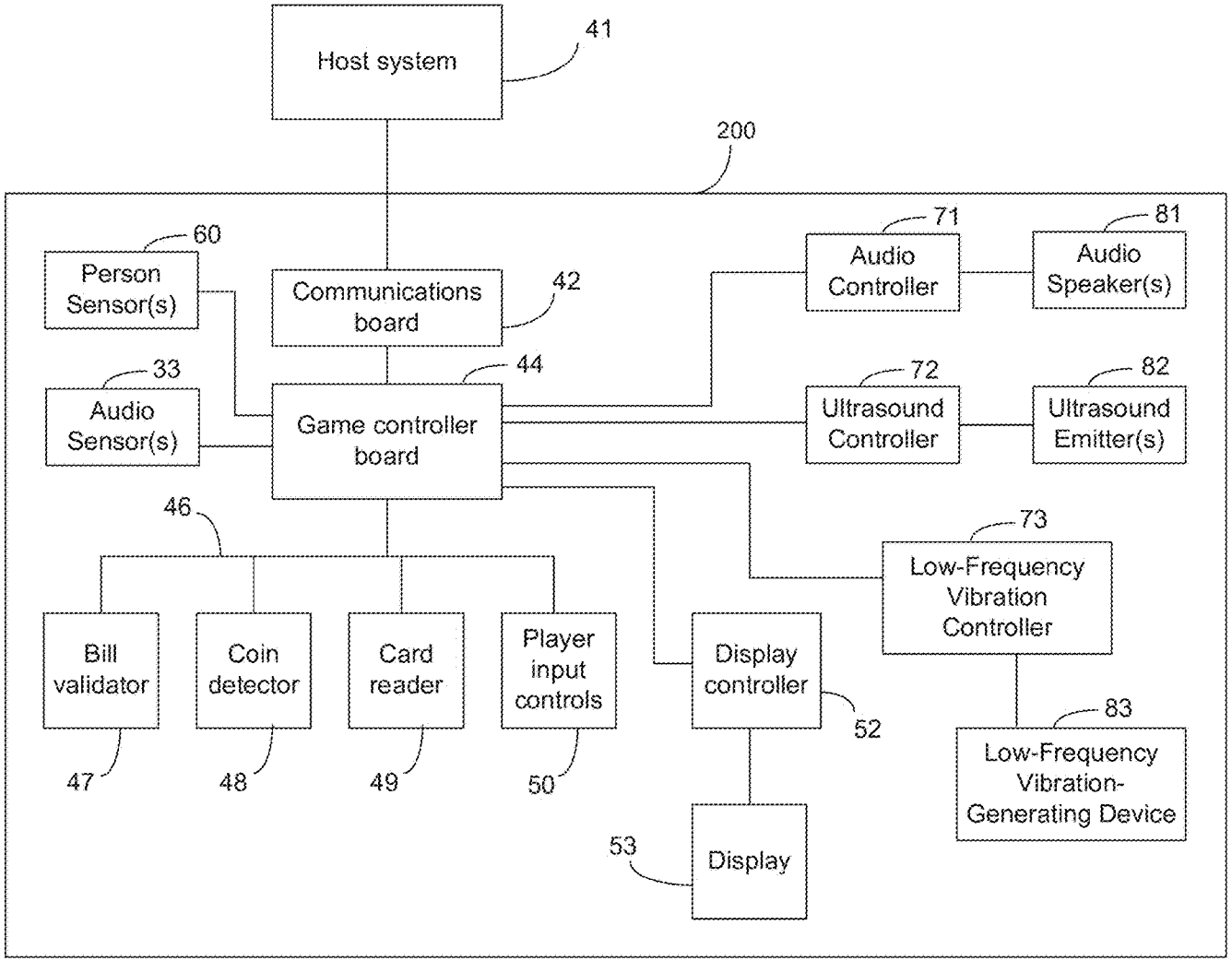
FIG. 3 is a block diagram illustrating an exemplary electronic gaming machine system in accordance with some embodiments.

FIG. 3 is a block diagram of exemplary electronic components of an exemplary electronic gaming machine system 200 linked to a casino or other suitable venue's host system 41, in accordance with some embodiments. In the example shown, a communications board 42 may contain circuitry for coupling the electronic gaming machine system 200 to a local area network (LAN) and/or other type of network using any suitable protocol, such as the G2S protocols. Internet protocols are typically used for such communication under the G2S standard, incorporated herein by reference. Communications board 42 may transmit using a wireless transmitter, and/or may be directly connected to a network running through the casino (e.g., throughout the casino floor). Communications board 42 may set up a communication link with a master controller and may buffer data between the network and game controller board 44. Communications board 42 may also communicate with a network server, such as in accordance with the G2S standard, for exchanging information to carry out embodiments described herein.

Game controller board 44 may contain memory and one or more processors for carrying out programs stored in the memory and for providing the information requested by the network. Game controller board 44 may execute programs stored in the memory and/or instructions received from host system 41 to carry out game routines. In some embodiments, game controller board 44 may execute programs stored in the memory and/or instructions received from host system 41 to perform one or more techniques described herein (e.g., techniques for generating private and/or public sound signals). In some embodiments, game controller board 44 may execute programs stored in the memory and/or instructions received from host system 41 to perform one or more tasks described herein.

In some embodiments, game controller board 44 may be configured to execute wagering game software. The wagering game software may receive one or more inputs from player control inputs 50. In some embodiments, the wagering game software executing on game controller board 44 may comprise execution of a random number generation (RNG) function to determine an outcome in a wagering game. The RNG may use a formula or an algorithm comprising a series of instructions for generating the random numbers. The formula or algorithm may be stored in a memory of game controller board 44. In some embodiments, the formula or algorithm associated with the RNG function may depend on the return to player (RTP) specific to the casino venue where the wagering game play takes place. The outcome of the game play may be signaled to the player via visual and/or audio content, depending on the specific game being played. Display controller 52 may adapt the coded signals representing the outcome of the game play to cause display(s) 53 to display a visual representation of the game play.

In some embodiments, a wagering game presented via a casino electronic gaming machine cabinet may include a reel-spinning game. The form of play of the reel-spinning game may be to virtually spin a set of virtual reels having various symbols located at regularly spaced intervals ("stops") on the reels. Portions of the virtual reels may be depicted on a display screen of the casino electronic gaming machine cabinet as if the physical reels were placed side-by-side behind a window that leaves only a limited number of symbols on each reel visible through the window at any time. The player may place a wager on one or more paylines, each forming a pattern of symbol locations within the window on the reels. When the reels are spun, the symbols that appear in the window on the display when the reels stop spinning may be checked along each of the paylines on which a wager was placed, to determine whether any winning symbol combinations occur on those paylines to result in a win (and possible payout) for the player.

In some embodiments, each reel may be represented in memory as a data structure including a list of the symbols on that reel along with any suitable data sufficient to determine which symbols will appear in the display window each time the reel is spun. For example, in some embodiments, a reel may be represented as a data structure including a list of all of the virtual stops on the reel, with an individual symbol assigned to each stop. When the virtual reel is spun, a system processor may execute a random number generation function to select one of the virtual stops at random, with each of the virtual stops having an equal probability of selection. One or more system processors may execute an animation routine to simulate the reel spinning on the display of the casino electronic gaming machine cabinet, and then display the symbols listed in the data structure as occurring at the selected virtual stop when the animation concludes and the virtual reel stops spinning. In this case, the probability of a particular symbol appearing when the virtual reel is spun may be determined by the number of virtual stops on the reel occupied by that particular symbol. In another example, a reel may be represented in memory as a data structure listing each possible symbol only once, in association with a different occurrence probability for each symbol. For example, a reel could be defined to have the J symbol occur with 50% probability, the Q symbol with 30% probability, and the K symbol with 20% probability. When the reel is spun, a random number may be generated for each symbol position appearing on the display for that reel, and the symbol depicted for that position when the reel stops spinning may be selected by comparing the generated random number with the probabilities stored in the data structure for that reel. For example, if the random number is between 0 and 0.5, the J symbol may be displayed; if the random number is between 0.5 and 0.8, the Q symbol may be displayed; and if the random number is between 0.8 and 1, the K symbol may be displayed. Other examples are possible, and embodiments are not limited to any particular form of data structure for representing a virtual reel. In yet another example, the data structure may list, instead of individual symbols, all possible symbol sequences that could appear in a display window of a particular size for that reel, along with an occurrence probability for each symbol sequence.

Typically in a reel-spinning game, the amount of winnings that a player receives as a payout resulting from a given reel spin depends on which paylines the player has placed wagers on, which symbols occur on those paylines when the reels stop spinning, and how much that particular combination or pattern of symbols pays. In some embodiments, the set of available paylines and the mappings from particular symbol combinations to particular payouts may be stored in memory in any suitable form of data structure, and the system may access these data at the conclusion of a reel spin to determine whether any winning combinations have occurred on paylines on which the player has wagered, and to compute the amount of any applicable payout to award to the player. The possible winning symbol combinations and the amounts of their corresponding payouts may also be provided to the player in the form of a pay table, to inform the player as to what symbol combinations and payouts the player could hope to achieve by continued play of the reel-spinning game. For instance, in one example the combination of three bell symbols occurring in a row could be defined in the pay table as a winning combination. The amount of the payout listed in the pay table and stored in memory for a particular winning symbol combination may be set in any suitable form, such as an absolute monetary amount, or a multiple of the player's wager on the payline. Likewise, the payout may be awarded to the player in any suitable way, such as by physically releasing currency and/or tokens from the casino electronic gaming machine cabinet, by digitally adding the payout to any form of stored value card, by crediting the player's electronic account for access to the money elsewhere than the casino electronic gaming machine cabinet, by authorizing the player for an equivalent number of free casino games, and/or in any other suitable way.

In some embodiments, one or more bonus rounds of the reel-spinning game may be triggered by any suitable bonus-triggering event from the main portion of the game, such as the occurrence of a particular symbol or combination of symbols. Bonus triggers are not necessarily limited to symbol occurrences, however; other examples of suitable bonus-triggering events may include reaching a particular amount of total winnings in the reel-spinning game, completing a particular number of reel spins in the main game, applying a bonus credit received from another game or a promotion in the casino, etc.

Game controller board 44 that executes the wagering game software may communicate with various peripheral devices/boards via a bus 46 using, for example, an RS-232 interface. Such peripherals may include a bill validator 47, a coin detector 48, a smart card reader and/or other type of credit card reader 49, and/or player control inputs 50 (such as buttons 39 and/or a touch screen). Game controller board 44 may also control one or more devices that produce video and/or audio output associated with a particular game that is presented to the user. Display controller 52, for example, may convert coded signals into pixel signals for one or more displays 53 (e.g., display 12 and/or display 14). In some embodiments, display 12 and/or 14 may be configured to output 3D video content. Display controller 52 may be directly connected to parallel ports on game controller board 44. In some embodiments, the electronics on the various boards may be combined in any suitable way, such as onto a single board.

In some embodiments, game controller board 44 may be connected to and may provide control signals for audio controller 71. In some embodiments, audio controller 71 may be connected to and may drive one or more audio speakers 81. Some examples of suitable audio speaker(s) 81 include audio speakers 27 and 28 of FIG. 1, and any of emitting devices 212, 213, 214 and 215 of FIG. 2. Audio speaker(s) 81 may be configured to play sounds in an audible frequency range, such as any suitable range of frequencies between 20 Hz and 20 KHz. In some embodiments, game controller board 44 may control audio controller 71, which, in response, may cause audio speaker(s) 81 to play one or more sounds. For example, audio controller 71 may comprise a signal amplifier, a power amplifier, a digital filter, an analog-to-digital converter, an analog filter and/or any other suitable device. In some embodiments, game controller 44 may control audio controller 71 to cause audio speaker(s) 81 to play one or more public sound signals.

Whether during a wagering game or while no game is being played (e.g., in attract mode, when an available electronic gaming machine issues greetings to passersby in an attempt to attract their attention and entice them to come play a game), program code running on game controller board 44 may execute a sound signal output routine. As part of the routine, in some embodiments, game controller board 44 may determine whether the sound signal to be played should be public or private. This may be done in any suitable way. For example, in some embodiments, game controller board 44 may access one or more rules that may be applied to a given sound signal to determine whether the sound should be public or private. In some embodiments, a look-up table may be stored in memory that maps each different sound or type of sound to a designation of whether that sound should be public or private, and the control circuitry of game controller board 44 may compare the current sound signal to be played with a corresponding field of the look-up table to retrieve its designation. If it is determined that the sound to be output is designated as a public type of sound, in some embodiments game controller board 44 may generate the desired public sound signal and may control audio controller 71 to cause audio speaker(s) 81 to play the desired public sound signal directly in the audible frequency range.

Any suitable type(s) of sound(s) may be designated as public and played via audio speaker(s) 81, in accordance with any suitable design considerations of a particular wagering game, a particular machine, a particular venue, a particular operator, etc. For example, in some embodiments a win acknowledgment sound such as a jackpot sound may be designated as a public sound which is to be made audible to people other than the player of the game who scored the win. Accordingly, in some embodiments, when a player scores a win in a wagering game being played, game controller board 44 may generate one or more win acknowledgment sounds and may designate the one or more win acknowledgment sounds as public sounds. As discussed above, the inventors have appreciated it may be desirable to make win acknowledgment sounds audible to people other than the player(s) currently playing the game, e.g., to make the game seem attractive, and/or to make the venue seem like a fun and exciting place. Other examples of designated public sounds may include exciting or otherwise pleasing or engaging music, sound effects, and/or any other suitable sounds desirable to be heard by people other than the machine's player, for any suitable reason. In some embodiments, the number and/or type(s) of sounds that are designated as public may be adaptable according to any suitable circumstances, such as time or the environment. For example, in some embodiments, game controller board 44 may be programmed to designate more sounds as public when the background sound level in the surrounding environment is otherwise low (e.g., as determined via audio sensor 33), and/or at particular times of day or days of the week or dates at which a higher level of sound in the venue is desirable, such as during evenings, weekends, holidays, parties, special events, promotions, etc.

In some embodiments, game controller board 44 may also be connected to and provide control signals for ultrasound controller 72. In some embodiments, ultrasound controller 72 may be connected to and may drive one or more ultrasound emitters 82. Some examples of suitable ultrasound emitter(s) 82 include ultrasound emitters 29, 30 and 31 of FIG. 1, and any of emitting devices 212, 213, 214 and 215 of FIG. 2. In some embodiments, ultrasound emitter(s) 82 may be configured to emit one or more ultrasound carrier waves having frequencies above the audible frequency range (e.g., greater than 20 Khz). For example, in some specific embodiments, ultrasound emitter(s) 82 may be configured to emit ultrasound carrier wave(s) having frequencies between 30 KHz and 50 KHz. As discussed above, in some embodiments, a particular carrier frequency may be selected as suitable for a particular machine, application, design, etc. In some specific embodiments, the carrier frequency may be about 40 KHz. In some embodiments, game controller board 44 may control ultrasound controller 72, which, in response, may cause ultrasound emitter(s) 82 to emit one or more ultrasound carrier waves. For example, ultrasound controller 72 may comprise a signal amplifier, a power amplifier, a digital filter, an analog-to-digital converter, an analog filter and/or any other suitable device. In some embodiments, game controller board 44 may generate one or more private sound signals and use the generated private sound signal(s) to modulate the ultrasound carrier wave to be output via ultrasound emitter(s) 82. The private sound signals may be in an audible frequency range, such as about 20 Hz-20 KHz in some embodiments, or about 250 Hz-10 KHz in some embodiments, or any other suitable range of frequencies that are audible to the human ear.

As discussed above, the control circuitry of electronic gaming machine system 200 may determine whether a sound is to be public or private in any suitable way, such as by applying one or more rules and/or consulting one or more stored tables, in some embodiments. If it is determined that the sound signal is designated as private, in some embodiments game controller board 44 may generate the desired private sound signal in an audible frequency range, and may modulate one or more ultrasound carrier waves with the desired private sound signal (e.g., by amplitude modulation of the ultrasound carrier wave). Thus, in some embodiments, the resulting modulated ultrasound carrier wave may exhibit a fundamental frequency in the ultrasound range, with amplitude variations (an "envelope") that encode the private sound signal in the audible frequency range, which will be tracked by the listener's ear to hear the private sound signal. Game controller board 44 may then control ultrasound controller 72 to cause ultrasound emitter(s) 82 to output the modulated ultrasound carrier wave(s). In some embodiments, game controller board 44 may cause ultrasound emitter(s) 82 to output the modulated ultrasound carrier wave(s) toward a person who is in proximity to the electronic gaming machine system (e.g., to its display), such as a person playing a wagering game on cabinet 10 or a person walking or standing near cabinet 10. As discussed above, this may be a static location (e.g., a "sweet spot" in proximity to the electronic gaming machine system) in some embodiments, or may be an adaptable location that tracks the person's location, in some embodiments.

As one example, in some embodiments, certain sound effects within a wagering game may be designated as private sounds. For example, in some embodiments, sound effects produced when a loss occurs in the game may be designated as private sounds, so they will not be heard by people other than the player of the game. Any other game sound effects may alternatively or additionally be designated as private, so that people nearby need not be bothered by hearing the sound effects from someone else's game. As another example, in some embodiments some or all of the music played in association with a game may be designated as private, e.g., so that music played by neighboring electronic gaming machines will not overlap and clash with each other.

Another example of a type of sound that may be designated as private may include menu sounds. Accordingly, in some embodiments, game controller board 44 may generate one or more menu sounds and may designate the one or more menu sounds as private sounds. Menu sounds may be generated as a player browses through the menus of a wagering game of the electronic gaming machine. For example, a recorded voice may be played reading the menu headings. As another example, suitable sounds such as recorded voices or other acknowledgment sounds may be output when the player presses a button, such as the "bet one" button, the "play max" button, the "cash out" button, etc. As another example, in some embodiments, game controller board 44 may generate one or more audio instructions and may designate the one or more audio instructions as private sounds. Audio instructions may be generated, for example, to provide a player with tutorial information on how to play a wagering game, or to instruct the player to perform a certain action at a certain point in a wagering game, or to make a choice, etc. As another example, verbal outputs such as information regarding a player's current score, account balance, time remaining in a game or round, or any other suitable informational outputs may be designated as private so that others need not be bothered by hearing them. It should be appreciated that these are merely some examples, and any suitable type(s) of sounds may be designated as private in various embodiments, without limitations. Further, any of the sounds discussed above as examples of sounds that may be designated as public in some embodiments may alternatively be designated as private in some embodiments. In some embodiments, all sounds produced by electronic gaming machine system 200 may be designated as private, and no sounds may be played publicly.

In some embodiments, as discussed above, electronic gaming machine system 200 may comprise one or more low-frequency vibration-generating devices 83 that may be used to provide private sounds to a player in a low frequency range. The low-frequency vibration-generating device(s) 83 may be connected to and driven by low-frequency vibration controller 73, which may be connected to and controlled by game controller board 44. An example of a suitable low-frequency vibration-generating device 83 is low-frequency vibration-generating device 211 of FIG. 2. Low-frequency vibration controller 73 may comprise a signal amplifier, a power amplifier, a digital filter, an analog-to-digital converter, an analog filter and/or any other suitable device. In response to a control signal provided by game control board 44, low-frequency vibration controller 73 may cause low-frequency vibration-generating device(s) 83 to vibrate, in some embodiments, thus causing the seat of electronic gaming machine system 200 (or another apparatus with which the player has physical contact, such as a floor panel on which the player stands, a joystick or other controller that the player holds, etc.) to vibrate in waves corresponding to a sound signal that can travel through the player's body (e.g., by bone conductance) to be perceived by the player's ears as sound. In some embodiments, the low-frequency vibrations may only be perceived by the person touching the apparatus being vibrated, thus providing private sounds not audible to others. In some embodiments, as discussed above, such low-frequency vibrations may be used to provide private sounds in cooperation with the modulated ultrasound, e.g., with vibration-generating device(s) 83 providing at least those private sounds that are lower in frequency than the minimum cut-off frequency of private sounds with which the ultrasound carrier waves are modulated.

As another example, in some embodiments attract mode sounds may be designated as private sounds. Accordingly, in some embodiments game controller board 44 may generate one or more attract mode sounds and may designate the one or more attract mode sounds as private sounds. In some embodiments, electronic gaming machine system 200 may enter attract mode when no player is currently using the machine. In attract mode, sounds designed to draw the attention of a person walking by the electronic gaming machine system may be played to entice the person to initiate wagering game play using the system. For example, recorded prompts may be played such as, "Hey there! Would you like to play a game? You could be the next big winner!" In some embodiments, an animated character may be portrayed on the display of cabinet 10, and may gesture at the person and appear to be talking to the person as the attract mode prompts are played. The inventors have recognized that these types of sounds, while they may be effective in attracting some people to play wagering games, can also be annoying to other people nearby, especially when the prompts are played repeatedly. People passing by electronic gaming machines may also become desensitized to attract mode sounds when they heard them constantly from machines all over the casino floor, such that the sounds and characters may become less effective in attracting players.

Accordingly, in some embodiments, attract mode sounds may be designated as private sounds, and may be output via modulated ultrasound so that they are directed only to one person being targeted by the attract mode sounds. The inventors have appreciated that this may enhance the effectiveness of the attract mode sounds, by making them more unexpected and surprising to the person passing by, while also decreasing or eliminating the annoying effect of repeated attract mode sounds on others. In some embodiments, in response to determining that a person is in proximity to display 53 of electronic gaming machine system 200 (which may include equivalently determining that the person is in proximity to any other portion of electronic gaming machine system 200), game controller board 44 may modulate one or more ultrasound carrier waves with one or more attract mode sounds and may output the modulated ultrasound wave(s) toward the detected person's location via ultrasound emitter(s) 82. In some embodiments, the modulated ultrasound may be directed to a static location (a "sweet spot"), and the person may be detected when the person enters or approaches that spot in proximity to the electronic gaming machine system. In other embodiments, the person's location in proximity to the electronic gaming machine system may be tracked, and the modulated ultrasound may be adaptively directed to the tracked location. In some embodiments, in response to determining that the person is no longer in proximity to display 53 (e.g., because the person has passed by without stopping to play a game), game controller board 44 may stop the outputting of the modulated ultrasound waves. This may conserve energy and/or processing resources, in some embodiments.

In some embodiments, for detecting that a person is in proximity to the electronic gaming machine system, and/or for tracking the person's location in proximity to the system and therefore to its display, one or more sensors 60 may be connected to game controller board 44. An example of a suitable sensor 60 is position sensor 26 of FIG. 1, which may be configured to detect the location of a person. In some embodiments, sensor(s) 60 may comprise one or more cameras, such as camera 25 of FIG. 1. In some embodiments, the camera(s) may be configured to detect the location of a person by capturing an image showing the person in proximity to display 53. The image captured by the camera(s) may be processed, for example by game controller board 44, to recognize the presence of a person's body, a head, face, one or two ears, and/or any other suitable part of a person. In some embodiments, game controller board 44 may use a facial recognition algorithm, or any other suitable algorithm, to detect the presence of a person in the captured image.

In some embodiments, data corresponding to the player's location may be stored in a memory of game controller board 44. As discussed further below, game controller board 44 may use the data corresponding to the player's location to determine the emission direction of one or more ultrasound beams, in some embodiments.

Figure 4A:
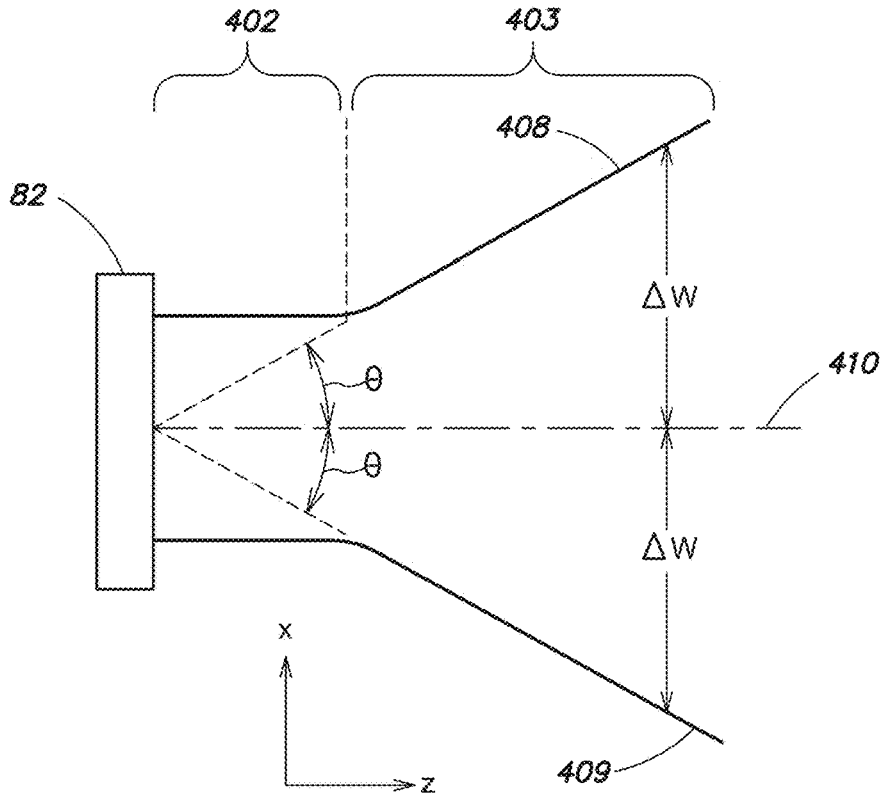
FIG. 4A is a diagram illustrating an exemplary ultrasound beam in accordance with some embodiments.

As described above, ultrasound emitter(s) 82 may be configured to emit ultrasound waves in a particular direction (e.g., toward a person), such that other persons positioned outside of the ultrasound beam cannot hear the private sound signal with which the ultrasound carrier wave is modulated. To selectively reach one person while not reaching others, in some embodiments ultrasound emitter(s) 82 may be designed to have a narrow emission cone. FIG. 4A is a diagram illustrating an exemplary ultrasound beam emitted by an ultrasound emitter 82 in accordance with some embodiments. The z-axis in FIG. 4A defines the direction in which the ultrasound wave is emitted and travels away from the emitter. The x-axis defines the direction in which the width of the ultrasound beam's cone is measured, and is orthogonal to the propagation axis (z-axis). In some embodiments, the x-axis may be defined orthogonal to the propagation axis and generally parallel to the floor; however, in some embodiments the ultrasound beam may generally be radially symmetric about the propagation axis, such that the x-axis may be arbitrarily defined in any direction orthogonal to the propagation axis without substantially changing any relevant measurement.

Figure 4B:
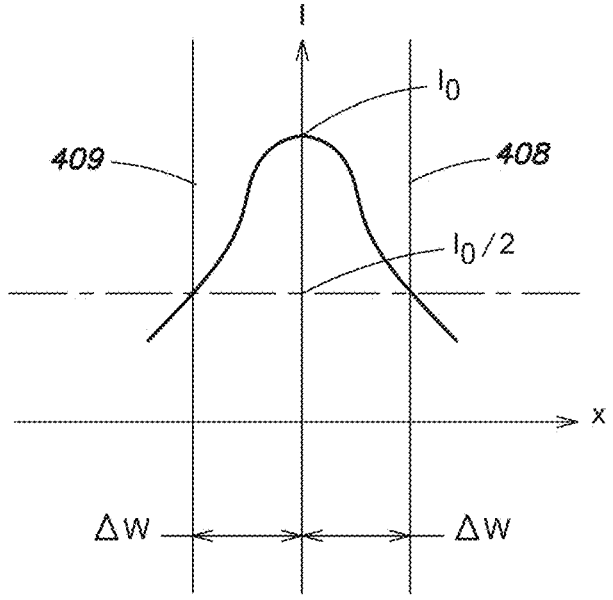
FIG. 4B is a graph illustrating an exemplary intensity profile of an ultrasound beam in accordance with some embodiments.

FIG. 4B is a graph illustrating the intensity profile of an ultrasound beam along the x-axis at any given location along the z-axis, and how the intensity profile defines the beam's width Δw, in accordance with some embodiments. In some embodiments, the beam may have a maximum intensity $I_0$ near the center of the beam, and may decay in intensity away from the center. The beam may have any suitable intensity profile such as a Gaussian profile, a sinc-function profile, an Airy-function profile, etc. The profile shape of the beam may be determined by the geometry of the ultrasound emitter, such as the shape of the aperture. In some embodiments, boundaries 408 and 409 may be defined as the locations, along the x-axis, where the intensity drops to $I_0/2$=half of the maximum intensity $I_0$. The beam's spatial width Δw may be defined as the distance, along the x-axis, between the location where the maximum of intensity occurs (i.e., the center of the beam) and boundary 408 or 409. In some embodiments, boundaries 408 and 409 may approach asymptotes that diverge linearly from each other as the ultrasound beam propagates away from the emitter along the z-axis.

Referring back to FIG. 4A, ultrasound beam 401 may have two propagation regions defined along the propagation axis (z-axis): a near-field region 402 and a far-field region 403, characterized by the behavior of the boundaries 408/409 in each region. In the near field region 402, the beam may have a nearly constant width along the z-axis, as the boundaries 408/409 may be relatively unchanging, or slowly changing. On the other hand, the beam may spatially broaden in the x-axis in the far-field region, such that Δw increases as the beam propagates along the z-axis away from ultrasound emitter 82. As the beam spatially broadens in the far-field region, the boundaries 408/409 may approach linear asymptotes that can be extrapolated back toward the emitter to a point of intersection. The angular beam width θ may be defined by the angle between propagation axis 410 and the linear asymptote approached by boundary 408, or 409, in the far-field region 403.

In some embodiments, ultrasound emitter 82 and/or its output ultrasound carrier wave may be constructed and/or configured such that the angular beam width θ of the emitted modulated ultrasound wave emitted is about $10^0$ or less in some embodiments, about $5^0$ or less in some embodiments, about $3^0$ or less in some embodiments, about $2^0$ or less in some embodiments, or any other suitably narrow width in other embodiments. In some embodiments, the angular beam width θ may be set by configuring the geometry of the ultrasound emitter, such as the size of the emitter's aperture. Alternatively or additionally, in some embodiments the angular beam width θ may be determined and/or controlled wholly or partially by the frequency of the ultrasound wave. For example, in some embodiments, increasing the ultrasound carrier frequency may decrease the angular beam width (making the beam narrower and more directional), while decreasing the ultrasound carrier frequency may increase the angular beam width. In some embodiments, different carrier frequencies may be used in different circumstances, depending on the desired width or narrowness of the ultrasound beam and correspondingly the desired width of the listening zone in which the private sounds carried by the ultrasound beam may be audible. For example, in some embodiments, a higher carrier frequency and thus narrower beam may be used in a multi-player setting in which it is desired to avoid allowing adjacent players to hear each other's private sounds, and/or in a stereophonic setting in which it is desired to avoid overlap between ultrasound beams carrying left-ear and right-ear signal components. In some embodiments, a lower carrier frequency and thus wider beam may be used in an attract-mode setting, in which it may be desired to widen the zone in which passersby may trigger greetings and hear the attract-mode prompts. In some embodiments, an intermediate carrier frequency and resulting beam width may be used for single-player game play with private sounds directed to any single player at the gaming machine.

Alternatively or additionally, in some embodiments, the initial intensity of the ultrasound beam may be specified such that as the maximum intensity $I_0$ decays as the wave propagates along the z-axis, the private sounds carried by the ultrasound wave become inaudible to listeners positioned more than a specified distance away from the emitter within the width of the ultrasound beam. For example, in some embodiments, the intensity of the modulated ultrasound carrier wave may be configured to make the private sounds comfortably audible at the distance of the targeted person from the electronic gaming machine display, but inaudible to people standing some distance behind the targeted person from the perspective of the emitter. In some embodiments, as discussed above, the intensity of the modulated ultrasound may be adjusted based on background noise level, to keep the private sounds comfortably audible and private to the targeted person.

Figure 4C:
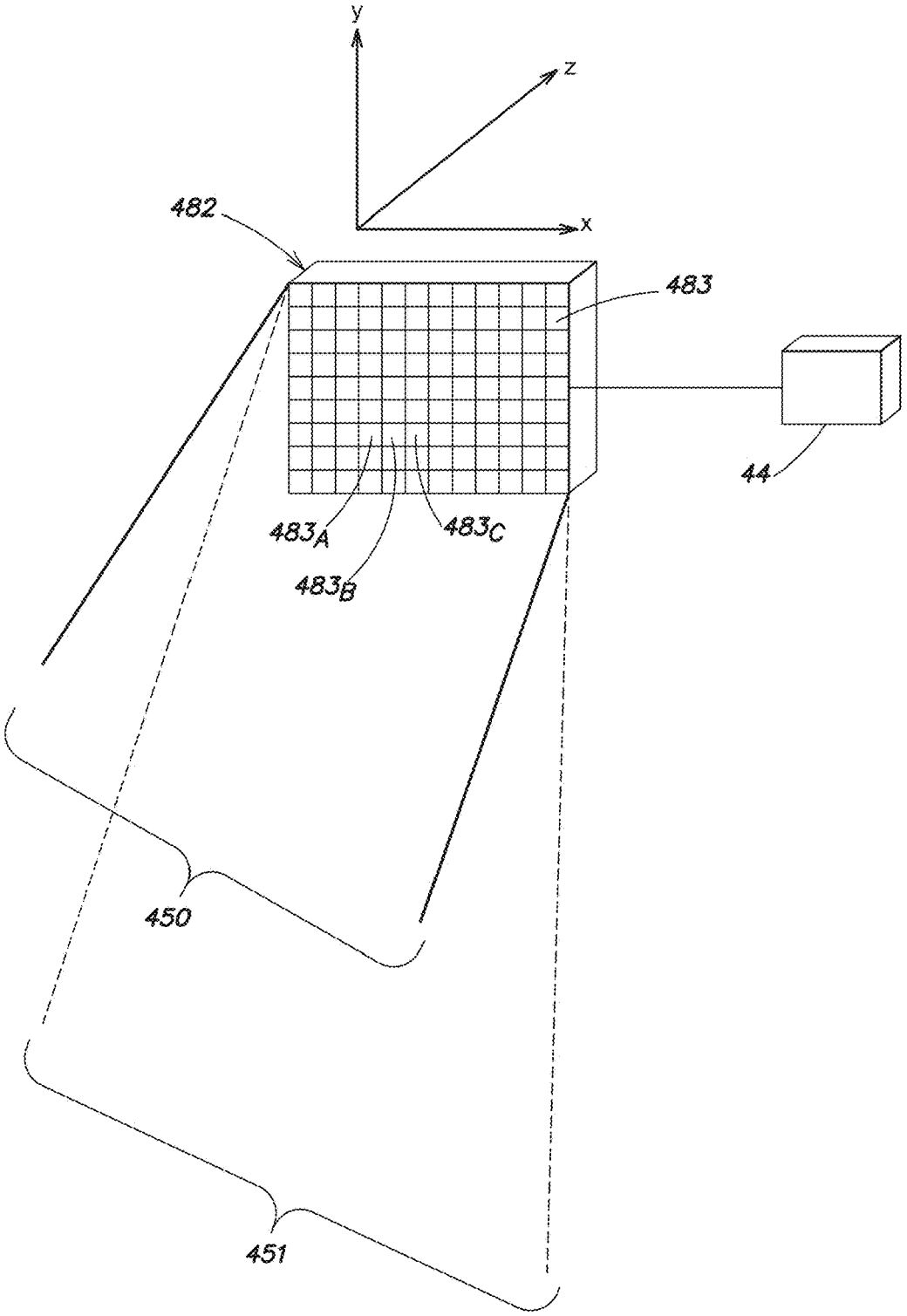
FIG. 4C is a diagram illustrating an exemplary controllable ultrasound emitter in accordance with some embodiments.

In some embodiments, the modulated ultrasound wave emitted by ultrasound emitter(s) 82 may be dynamically controlled to be emitted in a desired direction, which may track a targeted person's location, in some embodiments. This may be done in any suitable way, some examples of which are described below. FIG. 4C is a diagram illustrating one way in which the direction of ultrasound emission may be controlled in accordance with some embodiments. In some embodiments, ultrasound emitter(s) 82 may comprise one or more arrays of ultrasound transducers, such as piezoelectric transducers, capacitive transducers, or any other suitable type of transducer capable of converting electrical signals into vibrations producing longitudinal waves at ultrasound frequencies. FIG. 4C illustrates an exemplary array 482 of transducers 483. Array 482 may be controlled by game controller board 44 and ultrasound controller 72 (not shown in FIG. 4C). In some embodiments, game controller board 44 may control array 482 to emit the ultrasound beam in a desired direction. For example, array 482 may be controlled to output ultrasound beam 450 during a first time interval and beam 451 during a second time interval, where beams 450 and 451 are emitted in different directions.

In the example according to FIG. 4C, the emitting surface of array 482 may be disposed on an xy-plane. In some embodiments, game controller board 44 may control array 482 to direct the beam in a desired direction by adjusting the phase of the signals used to drive the various transducers 483. For example, assume that at time $t_0$ the various transducers 483 are driven by signals having the same phase. In this case, the beam output by array 482 may be directed parallel to the z-axis. At time $t_1$, the signals may be varied such that each column of transducers along the x-axis has a linearly growing phase difference. For example, if a transducer $\mathbf{483}_A$ is driven by a signal with phase $\varphi_0$, transducer $\mathbf{483}_B$, disposed next to transducer $\mathbf{483}_A$ along the x-axis, may be driven by a signal with phase $n\varphi_0$, where n is a positive or negative integer. Similarly, transducer $\mathbf{483}_C$, different from transducer $\mathbf{483}_A$ and disposed next to transducer $\mathbf{483}_B$ along the x-axis, may be driven by a signal with phase $2n\varphi_0$. In some embodiments, as a result of varying the phases of the signals driving the various transducers, the beam's emission direction in the x-axis may be varied. In some embodiments, the emission direction's angle with respect to the z-axis may be a function of n. A similar technique may be used to vary the beam's emission direction in the y-axis, in some exemplary embodiments.

In another example, the emission direction of one or more ultrasound waves from an array of ultrasound transducers may be controlled by driving only a subset of the transducers in the array to emit the ultrasound waves. For example, when it is determined that a targeted person is positioned at a location toward the left-hand side of the array, in some embodiments only a subset of the array's transducers toward the left-hand side of the array may be used to output the modulated ultrasound toward that location. Similarly, when it is determined that the targeted person is positioned at a location toward the right-hand side of the array, in some embodiments only a subset of the array's transducers toward the right-hand side may be driven. When the targeted person is relatively tall, such that the person's ears are located nearer to the top portion of the array, in some embodiments only a subset of the array's transducers toward the top may be driven. When the person is relatively short, or is sitting or slouching, such that the person's ears are located nearer to the bottom portion of the array, in some embodiments only a subset toward of transducers toward the bottom may be driven. It should be appreciated that any suitable subset of transducers in an array may be driven to output modulated ultrasound at any particular time to direct the modulated ultrasound toward the detected location of a targeted person.

In another example, ultrasound emitter(s) 82 may comprise one or more electrostatic ultrasound speakers, in some embodiments. In some such embodiments, game controller board 44 may be configured to control the beam's emission direction by physically changing the orientation of the ultrasound speaker(s). For example, in some embodiments, the emission direction of the modulated ultrasound may be adjusted by controlling the angular position of a rotating motor on which the electrostatic ultrasound speaker(s) are disposed. Similarly, in some embodiments, any other type of ultrasound transducer may alternatively or additionally be physically moved and/or rotated to control its direction of emission.

Figure 5B:
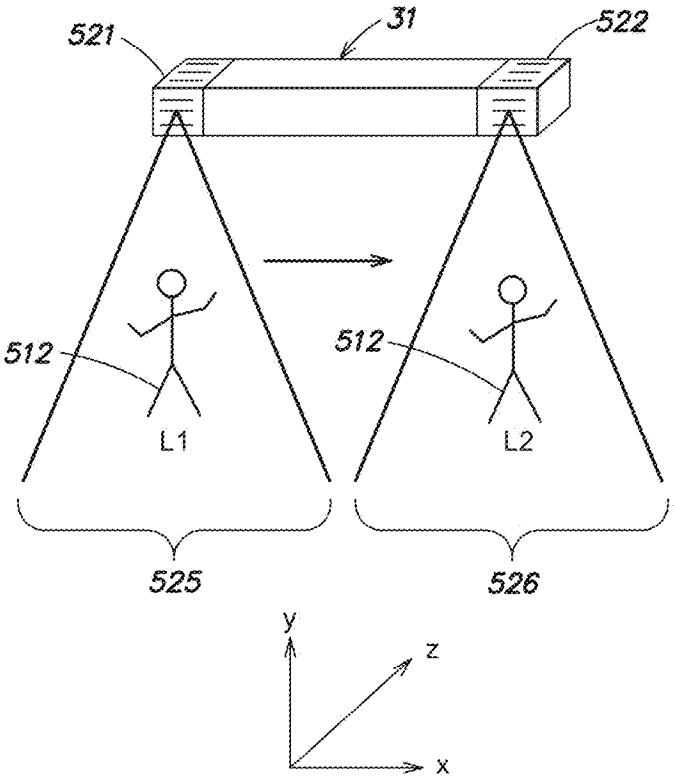
FIG. 5B is a diagram illustrating another example of position tracking in accordance with some embodiments.
Figure 5A:
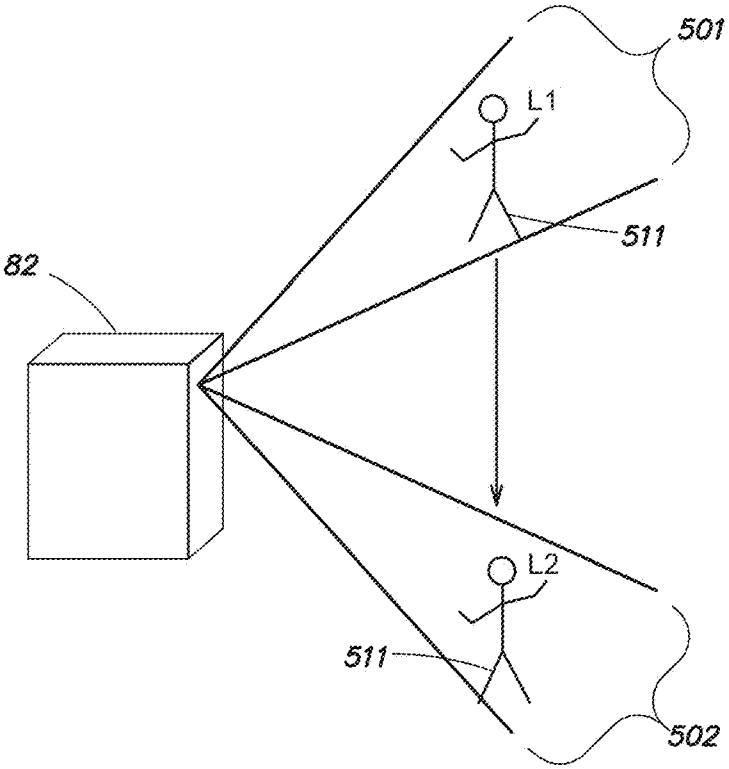
FIG. 5A is a diagram illustrating an example of position tracking in accordance with some embodiments.

In some embodiments, in response to detecting a change in a person's location, e.g., in proximity to display 53, game controller board 44 may be configured to redirect the modulated ultrasound wave(s) toward the person's new location. FIG. 5A illustrates an exemplary electronic gaming machine cabinet comprising one or more ultrasound emitters configured to track changes in a targeted person's location in accordance with some embodiments. Initially, a person 511 may be in a first location L1 in proximity to cabinet 10. The initial location L1 of person 511 may be detected through sensor(s) 60. Based on the detected location, game controller board 44 may control ultrasound emitter(s) 82 to emit a first modulated ultrasound beam 501 toward person 511, such that person 511 can hear the one or more private sound signals carried by the modulated ultrasound carrier. Subsequently, person 511 may move to a second location L2 in proximity to cabinet 10. For example, person 511 may be walking near cabinet 10 and may be hearing one or more attract mode signals. As another example, person 511, while playing a wagering game on electronic gaming machine system 200, may shift weight or otherwise change position in proximity to the display. In some embodiments, sensor(s) 60 may detect that the person has moved and may provide data corresponding to the person's new location to game controller board 44. Based on the detected new location, game controller board 44 may control ultrasound emitter(s) 82 to emit a second modulated ultrasound beam 502 toward the new location L2 of person 511, such that person 511 can continue to hear the one or more private sound signals at the new location L2. In some embodiments, the game controller board 44 and the ultrasound emitter(s) 82 may be configured to track a player's location to follow his/her movements, such that he/she can hear the private sound signal(s) without significant interruptions.

In some embodiments, in response to detecting a change in a person's location in proximity to display 53, game controller board 44 may be configured to vary the portion of the ultrasound emitter from which the ultrasound wave is emitted. FIG. 5B illustrates an exemplary ultrasound emitter configured to emit one or ultrasound beams from one or more portions in accordance with some embodiments. In some embodiments, ultrasound emitter 31 may be elongated along at least one direction, such as the x-axis or the y-axis. In some embodiments, ultrasonic emitter 31 may comprise a 2D array of transducers, or an array that has more columns than rows of transducers (or vice versa). In some embodiments, ultrasound emitter 31 may be configured to emit from different portions of the emitting surface, based on the detected location of person 512. Initially, person 512 may be in a first location L1 in proximity to cabinet 10. Based on the detected first location, ultrasound emitter 31 may output an ultrasound beam 525 from emitting portion 521 (e.g., by driving only the transducers in that portion), such that location L1 is in the path of ultrasound beam 525, and person 512 can consequently hear the modulating private sound signal at location L1. The portion of the emitting surface from which the ultrasound beam is emitted may be specified depending on the location of the player with respect to ultrasound emitter 31. Subsequently, person 512 may move to a second location L2 in proximity to cabinet 10. In response to detecting the person's movement and new location, ultrasound emitter 31 may stop the emission of ultrasound beam 525, and may emit a second ultrasound beam 526 from emitting portion 522 (e.g., by driving only the transducers in that portion), such that location L2 is now in the path of ultrasound beam 526, and person 512 can consequently hear the modulating private sound signal at location L2.

Figure 6:
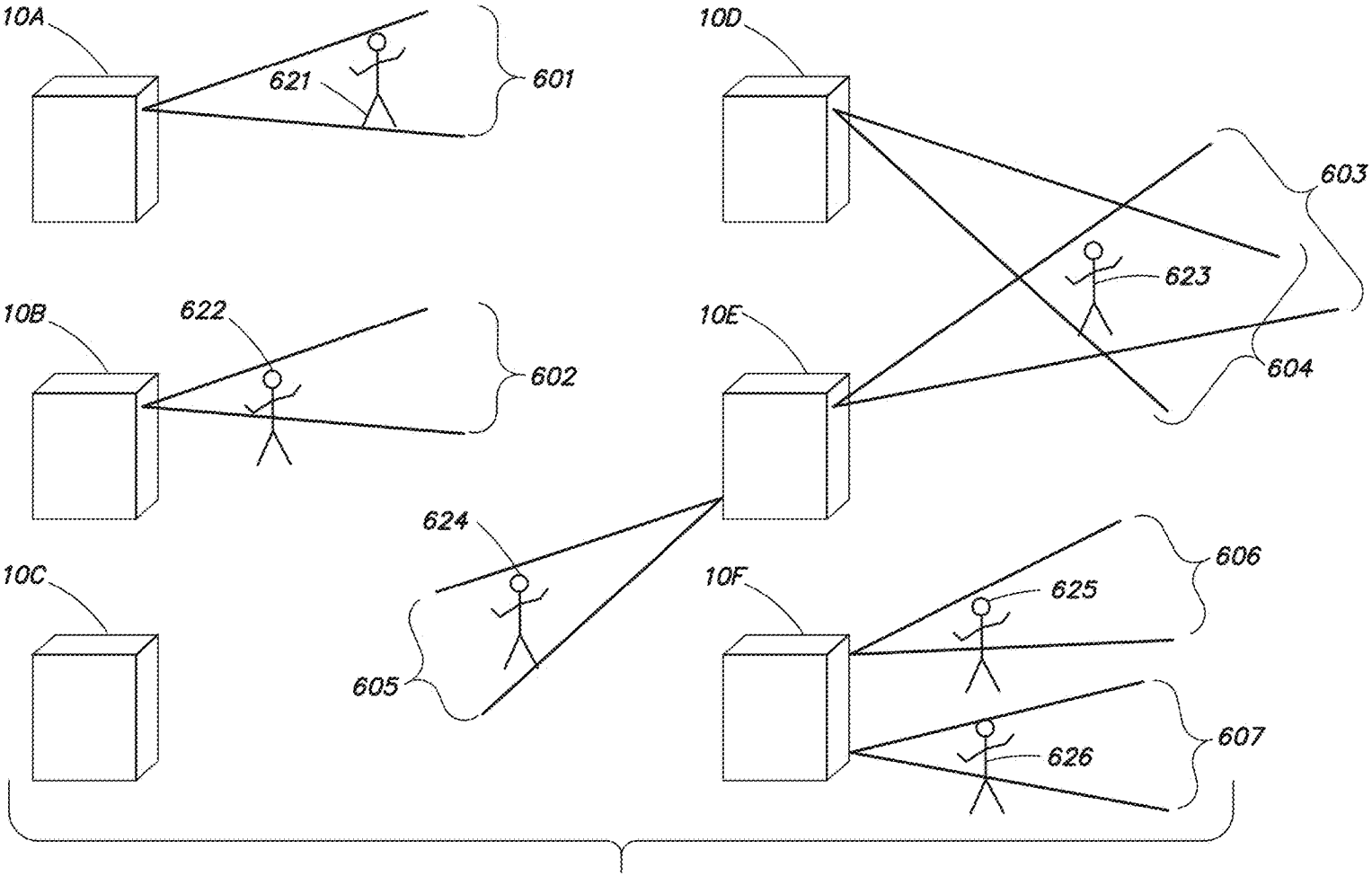
FIG. 6 illustrates an exemplary wagering gaming environment of electronic gaming machine systems in accordance with some embodiments.

An electronic gaming machine system, in some embodiments, may not be limited to directing private sounds to only one person at a time. In some embodiments, an electronic gaming machine system may be capable of directing private sound signals to more than one person. In some embodiments, an electronic gaming machine system may be configured to provide a first private sound signal to a first person and a second private sound signal to a second person. In some embodiments, two or more electronic gaming machine systems may provide private sound signals to the same person. Several examples of such scenarios are illustrated in the diagram of FIG. 6, which depicts an environment comprising a plurality of exemplary electronic gaming machine cabinets in accordance with some embodiments. Each cabinet $\mathbf{10}_A$, $\mathbf{10}_B$, $\mathbf{10}_C$, $\mathbf{10}_D$, $\mathbf{10}_E$ and $\mathbf{10}_F$ may be part of a different electronic gaming machine system. In the example of FIG. 6, cabinet $\mathbf{10}_A$ is directing a single ultrasound beam 601 toward a single person 621, and cabinet $\mathbf{10}_B$ is directing a different ultrasound beam 602 toward a different person 622. Cabinet $\mathbf{10}_E$, on the other hand, includes at least two ultrasound emitters and is directing a first ultrasound beam 605 toward person 624 and a second ultrasound beam 603 toward a different person 623. The first and the second ultrasound beam may be modulated with the same private sound signal, or alternatively, with different private sound signals.

In another example illustrated in FIG. 6, cabinet 10D and cabinet $\mathbf{10}_E$ are both directing respective ultrasound beams 603 and 604 toward the same person 623. For example, person 623 may be in proximity to both cabinets $\mathbf{10}_D$ and $\mathbf{10}_E$, and may receive a first attract mode sound from cabinet $\mathbf{10}_D$ and a second attract mode sound from cabinet $\mathbf{10}_E$. In some embodiments, however, this type of simultaneous directing of different private sounds from different electronic gaming machine systems to the same person (i.e., to the same location) may be avoided. For example, in some embodiments, the controllers of neighboring electronic gaming machine systems may coordinate such that one electronic gaming machine system may suppress output of attract mode sounds to a detected person when another electronic gaming machine system is already outputting private sounds (either in-game sounds or out-of-game sounds such as attract mode sounds) toward that same person's location.

In some embodiments, an electronic gaming machine system of the type described herein may be configured to provide multi-player gaming. For example, cabinet $\mathbf{10}_F$ may be configured to provide multi-player gaming to players 625 and 626. In some embodiments, the execution of the multi-player game software may include generating one or more secret sounds that are private to an individual player. Of these secret sounds, a first secret sound may be generated only for player 625 to hear, and a second secret sound may be generated only for player 626 to hear. For example, a secret sound may comprise information, alerts, hints, etc., and the multi-player game may be designed to use such secret sounds to convey such information to an individual player without revealing it to the other player. In executing such a game, the game controller board of cabinet $\mathbf{10}_F$ may generate the first and the second secret sounds in an audible frequency range. The game controller board may modulate a first ultrasound carrier wave with the first secret sound and a second ultrasound carrier wave with the second secret sound. In some embodiments, the first and the second ultrasound carrier waves may have the same frequency. In other embodiments, the ultrasound carrier waves may have different frequencies. Based on the detected positions of players 625 and 626, obtained via sensor(s) 60, the game controller board may output the first ultrasound beam 606 (modulated with the first secret sound) toward player 625 and the second ultrasound beam 607 (modulated with the second secret sound) toward player 626. In some embodiments, the game controller board may be configured to direct each ultrasound beam such that the portion of the beam within boundaries 408 and 409 (as defined with reference to FIGS. 4A-4B) encompasses the detected location of the intended target player and not the location of the other player.

In other cases, multi-player game software executed by an electronic gaming machine system may call for a shared private sound to be generated for both players 625 and 626 to hear. In such a circumstance, the game controller board may be programmed to output one ultrasound carrier wave toward player 625 and another ultrasound carrier wave toward player 626, where the ultrasound carrier waves may be modulated with the same private sound. Alternatively or additionally, the game controller board may be configured to modulate a single ultrasound carrier wave with the shared private sound, and to output the modulated ultrasound carrier toward both players 625 and 626, e.g., with a large enough beam width to encompass the locations of both players. While the example of cabinet $\mathbf{10}_F$ in FIG. 6 is illustrated as providing multi-player gaming to two players, it should be appreciated that electronic gaming machine systems of the type described herein may be configured to provide multi-player gaming for any other suitable number of players in various embodiments.

In some embodiments, the providing of different private sounds to different players of a multi-player game may be combined with providing different visual displays to the different players of the multi-player game. For example, in some embodiments, each player of a multi-player game may have a different dedicated display screen on which a different individual player view of the multi-player game may be displayed, either on the same shared electronic gaming machine cabinet or on different cabinets. The different players may then experience different visual scenes within the multi-player game while also hearing different secret sounds that are not audible to the other players of the game. In some other embodiments, the different visual scenes may be provided to the different players on the same display screen, either in a way that allows the different players to see each other's views (e.g., by dividing the shared screen into different portions directed to different players), or in a way that does not allow the different players to see each other's views. For example, in some embodiments, a shared display screen may be configured to provide to each player a private visual view that is not visible to other players of the multi-player game. This may be done, for example, using any of the techniques described in U.S. patent application Ser. No. 14/966,767, filed Dec. 11, 2015, and entitled, "Wagering Gaming Apparatus with Multi-Player Display and Related Techniques," which is incorporated herein by reference in its entirety.

For example, in some embodiments, the pixels of a display device of an electronic gaming machine system may be divided into different subsets configured to be visible to different players occupying different viewing zones in front of the display. This may allow a multi-player wagering game to be played on the electronic gaming machine system, with different views of the multi-player wagering game being displayed to the different players in the different viewing zones. For example, in some embodiments, a first player occupying a first viewing zone may be shown a first-player view of the multi-player wagering game via a first set of pixels of the display, while a second player occupying a second viewing zone may be shown a different second-player view of the multi-player wagering game via a second set of pixels of the display. The first-player view of the multi-player wagering game may include, for example, images and/or information not shown to the second player in the second-player view of the multi-player wagering game, and vice-versa. In some embodiments, the multi-player wagering game may involve cooperation and/or competition between the different players to produce an outcome of the wagering game, based at least in part on the differing images and/or information shown in the different player views. In some embodiments, each of the different player views of the multi-player wagering game may be a 2D image displayed in the respective viewing zone. In other embodiments, each of the different player views may be a stereoscopic (e.g., autostereoscopic) 3D view. In some embodiments, a lenticular lens may be used to project the views from different sets of pixels of the display to the different viewing zones.

The first-player view of the multi-player wagering game may be different from the second-player view. For example, in some embodiments, the first-player view may contain images and/or information not visible in the second-player view, and vice-versa. In some embodiments, the multi-player wagering game may engage the different players in competitive and/or cooperative game play via the differing player views, to determine outcomes of the wagering game. However, independent game play may also be provided to different players via the same display screen, without requiring any competitive and/or cooperative aspect to the game. For example, in some embodiments, the wagering game may be a reel-spinning game (e.g., slot machine game), and the different player views may allow each player to wager on and spin his own set of reels, using a common display screen, without being able to see the other player's reels at the same time. In some embodiments, one player's reels may have the same total set of symbols as another player's reels in the same multi-player game; however, this is not required.

In an example of a competitive multi-player reel-spinning wagering game, both players may simultaneously spin the same virtual reels having the same symbols, but each player may wager on different paylines and/or on different winning combinations of symbols, for instance. (Although examples of multi-player wagering games are described herein using the illustrative case having two players, it should be appreciated that many similar wagering games may allow for more than two players to play simultaneously using techniques described herein, e.g., by dividing the pixels of the display into more than two sets, projected into more than two viewing zones.) When a reel spin ends, although the same resulting symbols may be seen by both players on the reels, each player may have a different win/loss outcome based on the different paylines and/or symbols on which they placed wagers, and/or based on the amounts of the wagers. In some embodiments, while both players may see the same reels and symbols, each player's view may include a different animation showing that particular player's winning/losing paylines and/or symbols, and/or may include different information displayed, such as text informing that particular player of his win/loss outcome and/or amount; text, meters, etc., showing that particular player's total winnings/losses, account balance, etc., and/or any other suitable player-specific information and/or images.

In an example of a cooperative multi-player reel-spinning wagering game, each player may spin and be shown virtual reels having different symbols, and a goal of the multi-player game may be for both players together to complete a full set of symbols won by accumulating reel-spin wins involving those symbols, for instance. For example, each player's individual reels shown in that particular player's view may include only half of the full set of symbols, such that both players depend on each other's individual reel-spinning outcomes to collect the full set of won symbols and thereby achieve a jackpot, bonus round, or other desirable meta-outcome of the multi-player wagering game. It should be appreciated that the foregoing are merely some illustrative examples of possible cooperative and competitive multi-player reel-spinning wagering games presentable via a display that projects multiple different player views of the same screen area to multiple different players occupying different viewing zones, and many other examples of cooperative and competitive multi-player reel-spinning wagering games, as well as other types of multi-player wagering games, are possible and are intended to be within the scope of the inventive techniques described herein.

In an example of a non-competitive and non-cooperative multi-player reel-spinning wagering game, each player may be shown and may spin his own virtual reels, which may or may not have the same symbols as the other player's reels. In one example, the players may not be constrained to spin their reels simultaneously, but rather each player may independently spin his own reels whenever he decides to initiate a reel spin, regardless of the other player's timing in initiating reel spins.

In some embodiments, a multi-player wagering game may include rounds of a main game (e.g., a reel-spinning game) that may be interrupted by bonus rounds, which may be triggered in any of various known ways. In some embodiments, regardless of whether the main game rounds of the multi-player wagering game involve cooperative or competitive play or neither, one or more bonus rounds of the wagering game may involve cooperative and/or competitive game play. In some embodiments, a joint bonus round may be triggered for both players any time a bonus is triggered by either player. In other embodiments, certain events in the main game may trigger individual (single-player) bonus rounds, while other events may trigger joint bonus rounds.

Any suitable type of bonus game may be configurable for multi-player competitive and/or cooperative play using techniques described herein, and many examples are possible. By way of example and not limitation, in some embodiments a Battleship game may be provided, in which each player's view displays to that player the locations of only his own ships on a shared game board, with the locations of the other player's ships hidden. The players may take turns attempting to guess the locations of the other player's ships to "hit" and sink them to win the game. In some embodiments, game controller 44 may be configured to provide different private sounds to each of the players via modulated ultrasound carriers. For example, each player may receive audio information regarding the position of his/her ships, sound effects corresponding to visual actions occurring in that particular player's private view, etc.

In some embodiments, the electronic gaming machine cabinet may have a different set of input controls for receiving input from each player of a multi-player wagering game. For example, a first player occupying a first viewing zone to the left of the display screen's midline may use a first set of input controls located on the left-hand side of the cabinet, reachable by the first player from the first viewing zone. Similarly, a second player occupying a second viewing zone to the right of the display screen's midline may use a second set of input controls located on the right-hand side of the cabinet, reachable by the second player from the second viewing zone. Input received from the first player's set of input controls may control the first player's game play (e.g., for a reel-spinning game, placing wagers, designating paylines, initiating reel spins, etc.) as shown to the first player in the first player's viewing zone via the first player's set of pixels on the display screen. Input received from the second player's set of input controls may control the second player's game play as shown to the second player in the second player's viewing zone via the second player's set of pixels on the display screen. In some embodiments, the electronic gaming machine system may have as many different sets of input controls as the number of players that can be simultaneously accommodated in playing multi-player wagering games on the electronic gaming machine system.

In some embodiments, alternatively or additionally, the display of the electronic gaming machine system may include a touchscreen interface, and both/all players of the multi-player wagering game may be enabled to provide control input to the wagering game via the same touchscreen interface. In some embodiments, the one or more processors of the electronic gaming machine system may analyze touch input received via the touchscreen interface, and/or may analyze other accompanying data, and thereby determine which player provided each touch input. Touch input provided by the first player, for example, may be used to control the first player's game play in the multi-player wagering game, while touch input provided via the same touchscreen interface by the second player may be used to control the second player's game play in the multi-player wagering game. Touch input and/or other accompanying data may be analyzed to disambiguate which player was the source of the touch input in any suitable way. In one example, different players may be shown different virtual buttons in different portions of the display screen via their different player views projected to their different viewing zones, and touch input may be disambiguated by analyzing at which portion of the screen it was received. In another example, each player may be permitted to provide touch input on any portion of the display screen, and touch input may be disambiguated by detecting player movement via one or more sensors external to the display screen, and thereby determining which player moved to provide the touch input. Any suitable sensor(s) may be used to detect player movement. In one example, a sensor such as a ground plane sensor in a particular player's seat that is connected to or part of the electronic gaming machine system may provide data indicating when the player raises at least some portion of his weight from the seat to provide input via the touchscreen. In another example, a handheld sensor may provide data indicating when a particular player is moving his hand to provide input via the touchscreen. It should be appreciated that the foregoing examples of movement detection sensors, as well as the foregoing examples of techniques for disambiguating different players' touch inputs, are provided merely for purposes of illustration, and other examples are possible. Some embodiments are not limited to any particular techniques, devices and/or configurations for enabling multi-player touch input via a same touchscreen.

In some embodiments, different private sounds may be provided to different players playing a multi-player wagering game via the same electronic gaming machine system. For example, in some embodiments, secret sounds such as sounds conveying information, alerts, hints, etc., intended for only one of two players in a multi-player wagering game may be made audible only in the viewing zone occupied by that player, and not in the viewing zone occupied by the other player. In some embodiments this may be accomplished, as discussed above, by directing different modulated ultrasound beams to the different players occupying the different viewing zones. The secret sounds for one player thus may not be audible in the viewing zone occupied by the other player. In some embodiments, a wagering game may also include common (non-secret) sounds that may be made audible to both players in both viewing zones, e.g., via audio speakers.

Figure 7:
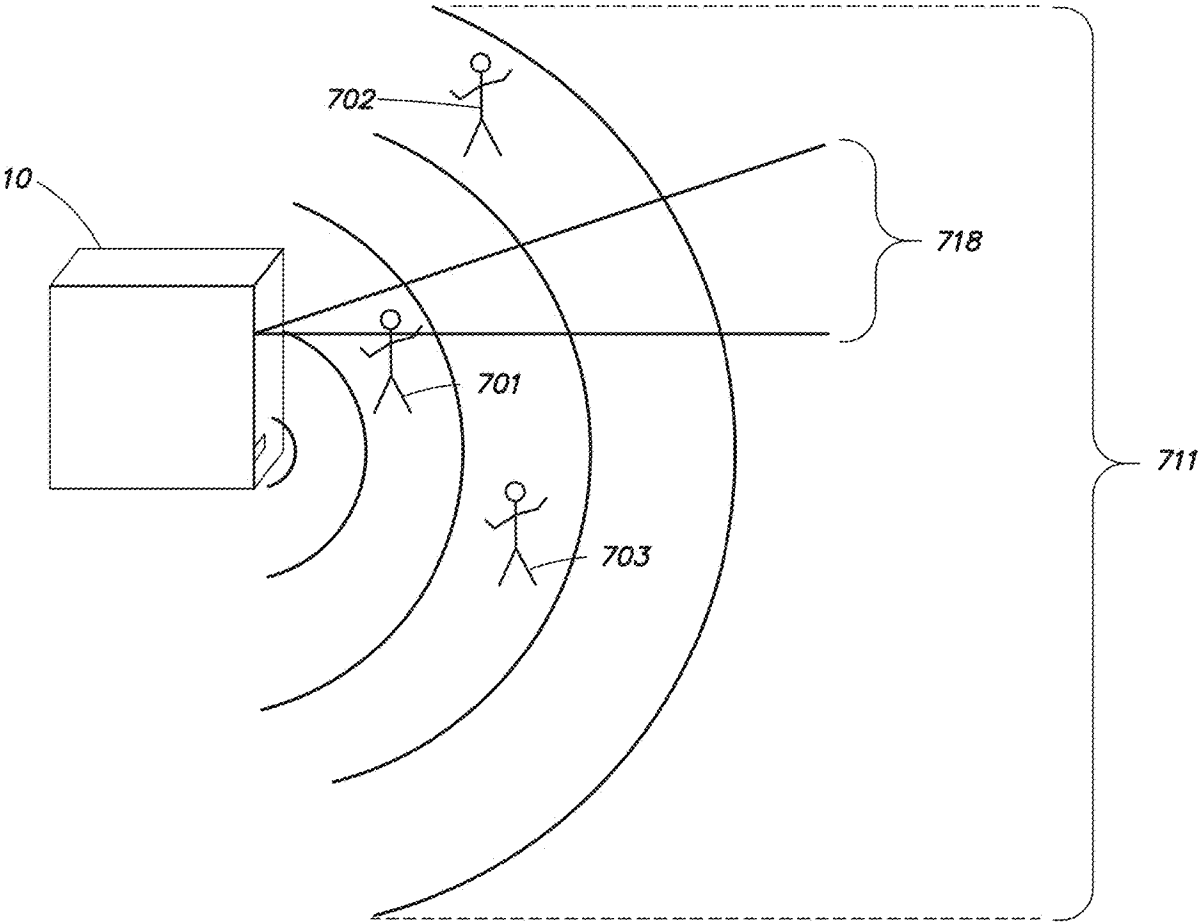
FIG. 7 is a diagram illustrating operation of an exemplary electronic gaming machine system in accordance with some embodiments.

In some embodiments, an electronic gaming machine system (whether configured for single-player or multi-player gaming) may be configured to play public sound signals via one or more audio speakers, as well as to output ultrasound waves modulated with one or more private sound signals toward the detected location of a person via one or more ultrasound emitters, as illustrated in the example of FIG. 7. Cabinet 10 in this example is configured to output ultrasound wave 718 toward the detected location of person 701, such that person 701 can hear a private sound signal carried by ultrasound wave 718. Cabinet 10 may be further configured to play a public sound signal 711 in the audible frequency range via one or more audio speakers, such that any person in proximity to cabinet 10 may hear the public sound. For example, persons 701, 702 and 703 may all be able to hear the public sound signal. In some embodiments, ultrasound wave 718 may be emitted at the same time as public sound signal 711. In other embodiments, ultrasound wave 718 and public sound signal 711 may be emitted at different times.

In some embodiments, a different private sound signal may be directed to each of a person's ears to create a stereophonic sound experience. As discussed above, a stereophonic sound signal may include a left-ear component and a right-ear component, which may be generated through known signal processing techniques to create sound localization perceptions when the two components are heard together at the corresponding ears. Some embodiments may provide each of these single-ear components of a stereophonic sound signal to the corresponding ear of a listener without the need for the listener to wear a receiving device on the ears such as headphones. The stereophonic sound system, in some embodiments, may direct one or more modulated ultrasound waves toward the person's left ear and one or more modulated ultrasound waves toward the person's right ear. The left-ear ultrasound carrier may carry the left-ear component of the stereophonic sound signal to the listener's left ear, while the right-ear ultrasound carrier may carry the right-ear component of the stereophonic sound signal to the listener's right ear. In some embodiments, the ultrasound emitters may be configured and positioned relative to each other to avoid crosstalk between the left and the right ear, as discussed further below. In some embodiments, the stereophonic sound system may be configured to produce 3D audio content. Illustrative applications for some of the techniques described herein are for use in a video game, in a television set, in a hi-fi system, in an wagering electronic gaming machine, in a music venue, in a theater, or in any other application for stereophonic sound.

Figure 8B:
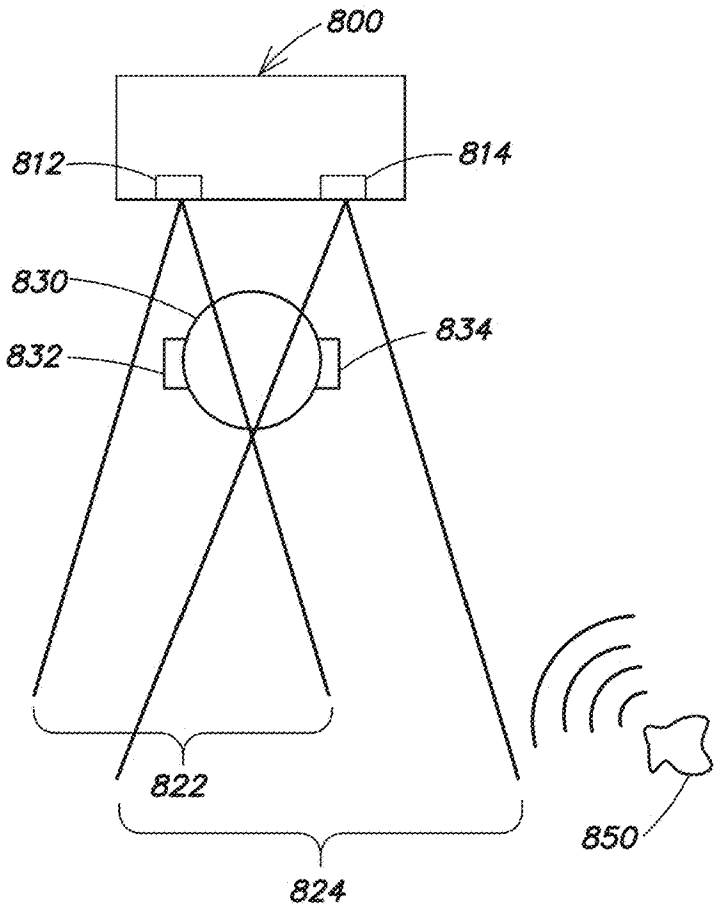
FIG. 8B is a diagram illustrating operation of an exemplary audio content delivery system in accordance with some embodiments.
Figure 8A:
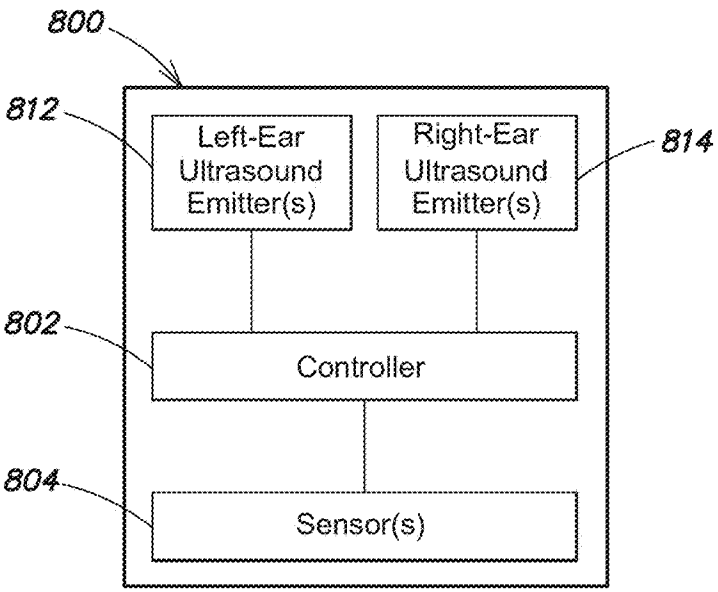
FIG. 8A is a block diagram illustrating an exemplary audio content delivery system in accordance with some embodiments.

FIG. 8A is a block diagram of an exemplary audio content delivery system 800 capable of delivering stereophonic sound in accordance with some embodiments. Audio content delivery system 800 may comprise at least a controller 802, one or more sensors 804, and a plurality of ultrasound emitters comprising one or more left-ear ultrasound emitters 812 and one or more right-ear ultrasound emitters 814. Left-ear ultrasound emitter(s) 812 and right-ear ultrasound emitter(s) 814 may comprise one or more electrostatic speaker(s) and/or one or more arrays of transducers, such as piezoelectric transducers, capacitive transducers, or any other suitable type of transducer. Any of the embodiments of ultrasound emitters discussed above in connection with providing private sound from an electronic gaming machine system may be utilized in audio content delivery system 800.

Sensor(s) 804 may be configured to detect the location of a person's left ear and the location of the person's right ear, in any suitable way using any suitable technique(s). In some embodiments, sensor(s) 804 may comprise one or more ultrasound sensors. In some embodiments, sensor(s) 804 may comprise one or more cameras. The camera(s) may be configured to detect the location of a person's left ear and the location of the person's right ear by capturing an image showing the person. For example, the captured image may be processed by controller 802 to detect the presence of the person's ears. As another example, the captured image may be processed to detect the presence of the person's head, face, or of any other suitable part of the person's body, and to infer the location of the person's ears based on the typical dimensions of a person's head and locations of a person's ears with respect to other recognizable features of the face, head, and/or other anatomical features.

In some embodiments, controller 802 may be configured to access a stereophonic audio signal having at least a left-ear component signal and a right-ear component signal in an audible frequency range. In some embodiments, the stereophonic audio signal may be stored in a memory 806 within audio content delivery system 800. The stereophonic audio signal may be generated in any suitable fashion. For example, the stereophonic audio signal may be generated using psychoacoustic sound localization methods, wave field synthesis techniques, ambisonics techniques, binaural techniques, or using any other suitable type of signal processing technique or method to generate a left-ear component and a right-ear component of the stereophonic audio signal.

In some embodiments, controller 802 may modulate one or more ultrasound carrier waves, which will be referred to as left-ear ultrasound carrier wave(s), with the left-ear component signal of the stereophonic audio signal. The modulated left-ear ultrasound carrier wave(s) may be provided to left-ear ultrasound emitter(s) 812. In some embodiments, controller 802 may be configured to control left-ear ultrasound emitter(s) 812 to output the modulated left-ear ultrasound carrier wave(s) toward the detected location of the person's left ear.

In some embodiments, controller 802 may modulate one or more ultrasound carrier waves, which will be referred to as right-ear ultrasound carrier wave(s), with the right-ear component signal of the stereophonic sound audio signal. The modulated right-ear ultrasound carrier wave(s) may be provided to right-ear ultrasound emitter(s) 814. In some embodiments, controller 802 may be configured to control right-ear ultrasound emitter(s) 814 to output the modulated right-ear ultrasound carrier wave(s) toward the detected location of the person's right ear.

FIG. 8B is a diagram showing a top view of exemplary audio content delivery system 800 comprising left-ear ultrasound emitter(s) 812 and right-ear ultrasound emitter(s) 814 outputting stereophonic audio to a listener. In some embodiments, audio content delivery system 800 may be configured to provide stereophonic sound privately to an individual person, such as person 830. In some embodiments, the location of the person's left ear 832 and right ear 834 may be detected via one or more sensors, such as one or more cameras. Audio content delivery system 800 may be configured to control left-ear ultrasound emitter(s) 812 to output left-ear ultrasound carrier wave(s) 822 toward the detected location of the person's left ear 832. Similarly, audio content delivery system 800 may be configured to control right-ear ultrasound emitter(s) 814 to output right-ear ultrasound carrier wave(s) 824 toward the detected location of the person's right ear 834. The left-ear ultrasound carrier wave(s) 822 and the right-ear ultrasound carrier wave(s) 824 may be respectively modulated with a left-ear component and a right-ear component of a stereophonic audio signal.

In some embodiments, when hearing the combination of the left-ear component signal and the right-ear component signal, person 830 may perceive audio signals as though they were provided by a virtual audio source 850 virtually positioned at any suitable location in space surrounding person 830.

In some embodiments, the ultrasound emitters and their carriers may be configured so as to keep crosstalk between the ears of person 830 below an acceptable threshold. As defined herein, crosstalk refers to the ratio between the power of the sound signal received at the person's right ear and the power of the sound signal received at the person's left ear (and vice versa). For example, the crosstalk may be less than −30 dB in some embodiments, less than −40 dB in some embodiments, less than −50 dB in some embodiments, less than −60 dB in some embodiments, less than −70 dB in some embodiments, less than −80 dB in some embodiments, less than −90 dB in some embodiments, or below any other suitable threshold. This avoidance of crosstalk may be achieved in any suitable way; for example by spacing the emitters apart from each other and/or setting the beam width and/or directionality of the ultrasound beams to reach the corresponding ears while avoiding overlapping with each other. In some embodiments, the modulated ultrasound wave(s) may be directed toward the person's ears without crossing each other before reaching the person's ears. As defined herein, waves are said to be crossing when corresponding regions between boundaries 408 and 409, as illustrated in FIG. 4A, overlap. In some embodiments, the modulated ultrasound wave(s) may cross each other after having reached and passed the person's ears (e.g., in the region behind the person's head), as illustrated in FIG. 8B.

In some embodiments, the one or more left-ear ultrasound emitters may be configured to emit the modulated left-ear ultrasound waves within an angular beam width of about $10^{o}$ or less in some embodiments, about $5^{o}$ or less in some embodiments, about $3^{o}$ or less in some embodiments, about $2^{o}$ or less in some embodiments, or in any other suitable narrow angular range. In some embodiments, the one or more right-ear ultrasound emitters may be configured to emit the modulated right-ear ultrasound waves within an angular width of about $10^{o}$ or less in some embodiments, about $5^{o}$ or less in some embodiments, about $3^{o}$ or less in some embodiments, about $2^{o}$ or less in some embodiments, or in any other suitably narrow angular range.

In some embodiments, in response to detecting a change in the person's left ear location and/or in the person's right ear location, the audio content delivery system may be configured to redirect the modulated left-ear ultrasound waves toward the person's new left ear location and/or the modulated right-ear ultrasound waves toward the person's new right ear location.

In some embodiments, an electronic gaming machine system comprising an audio content delivery system of the type described herein is provided. In some embodiments, electronic gaming machine system 200 may comprise audio content delivery system 800, and may be configured to provide stereophonic sound to a player, or in some cases to a group of players, in a casino venue or in any other suitable venue.

Figure 9:
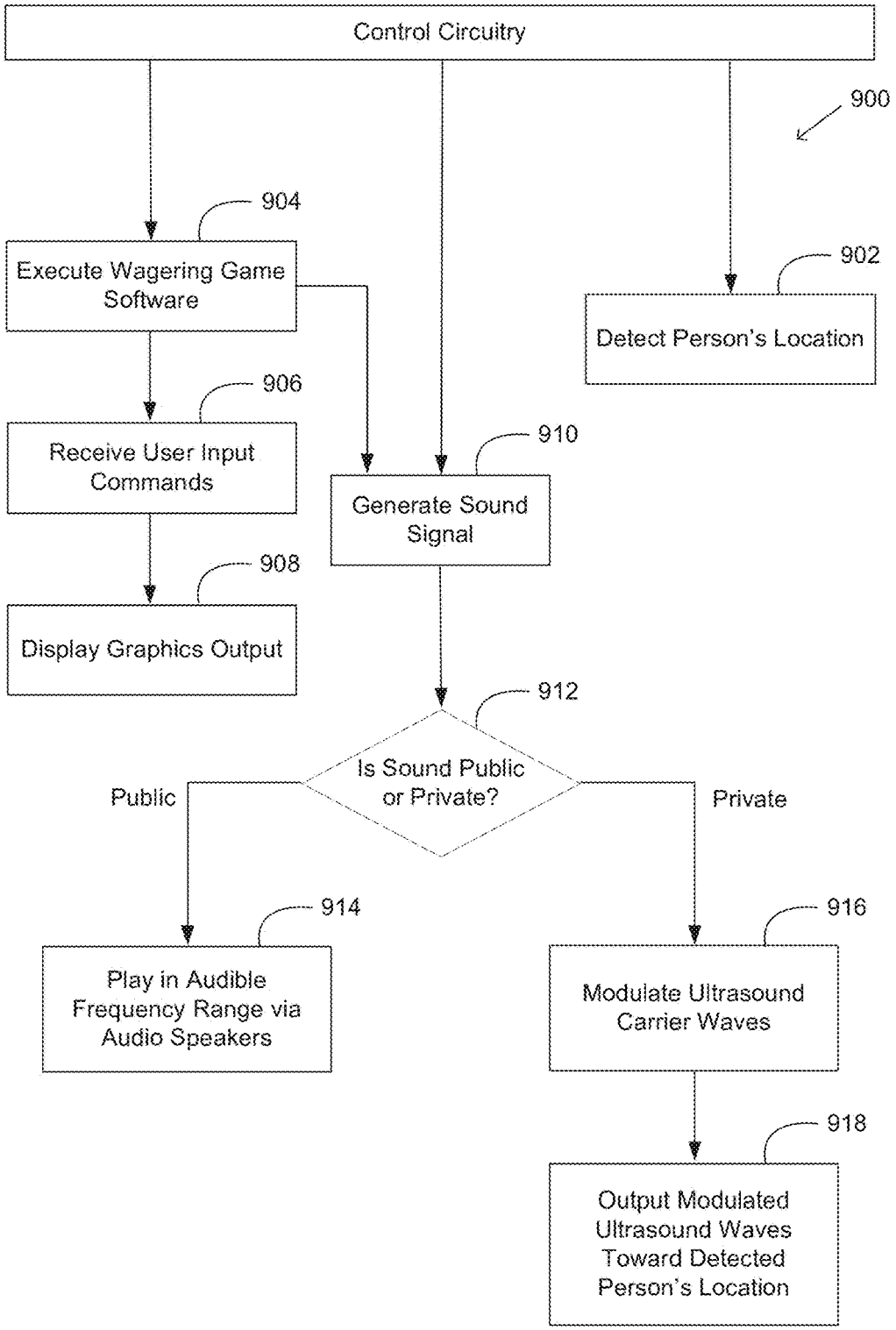
FIG. 9 is a flowchart illustrating an exemplary method of operation of an electronic gaming machine system in accordance with some embodiments.

It should be appreciated from the foregoing that one embodiment is directed to a method 900 for providing one or more private sound signals to at least one person from an electronic gaming machine system via ultrasound waves. Method 900 may be performed by control circuitry of an electronic gaming machine system in some embodiments, as illustrated in FIG. 9. At act 902, at which one or more sensors of the electronic gaming machine system may be used to detect a location of a person in proximity to a display of the electronic gaming machine system. For example, the sensor(s) may comprise one or more cameras, and the camera(s) may be configured to capture an image of a person in proximity to the display. The captured image may be transmitted to game controller board 44, which may detect the location of the person by detecting the presence of a head, a face, or any other suitable part of the person's body. For example, game controller board 44 may use a facial recognition algorithm. The detected location of the person may be stored in a memory, in some embodiments.

At act 904 (which may occur concurrently or asynchronously with act 902), wagering game software may be executed. The wagering game software may receive user input commands entered via one or more input controls of the electronic gaming machine system at act 906. For example, a player may press a button corresponding to a reel spin, and in response, game controller board 44 may execute a random number generation routine to determine an outcome of the game. At act 908, graphics output from the wagering game software responsive to the input commands may be displayed on the display of the electronic gaming machine system. For example, game controller board 44 may be provide a signal representing the determined outcome to display controller 52, which, in response, may convert the signal into pixel signals for one or more displays 53.

At act 910, a sound may be generated by the electronic gaming machine system. The sound may be generated as part of the execution of the wagering game software, or may be generated outside of the context of any game (e.g., in attract mode). At act 912, a determination may be made whether the sound to be output is public or private. For example, in some embodiments, as discussed above, game controller board 44 may access a set of rules or a table stored in a memory device, such as a look-up table. For each type of sound signal, the look-up table may contain a public/private designation or a rule for determining whether the sound should be public or private. If it is determined that the sound is to be public, method 900 may continue to act 914, at which the one or more public sound signals in an audible frequency range may be generated via control circuitry of the electronic gaming machine system. For example, audio controller board 44 may control audio controller 71 to convert the public sound signal(s) into the analog domain. The conversion into the analog domain may be such that the resulting signal is within an audible frequency range. The one or more public sound signals in the audible frequency range may be played via one or more audio speakers of the electronic gaming machine system. For example, audio controller 71 may amplify and feed the public sound signal(s) to the audio speakers.

On the other hand, if it is determined that the sound is to be private, method 900 may continue to act 916, at which one or more private sound signals in an audible frequency range may be generated via control circuitry of the electronic gaming machine system. At act 916, one or more ultrasound carrier waves may be modulated with the one or more private sound signals. For example, the ultrasound carrier wave may be generated using an ultrasound carrier generator, such as an oscillator, an astable circuit, or any other suitable type of generator, and may be amplitude-modulated in accordance with the private sound signal in the audible frequency range. At act 918, the modulated ultrasound waves may be output toward the detected person's location via one or more ultrasound emitters of the electronic gaming machine system. For example, game controller board 44 may access the detected location of the person from a memory, and may execute a routine that, based on the detected location, outputs one or more control signals. Game controller board 44 may use the control signal(s) to drive the ultrasound emitters.

Figure 10:
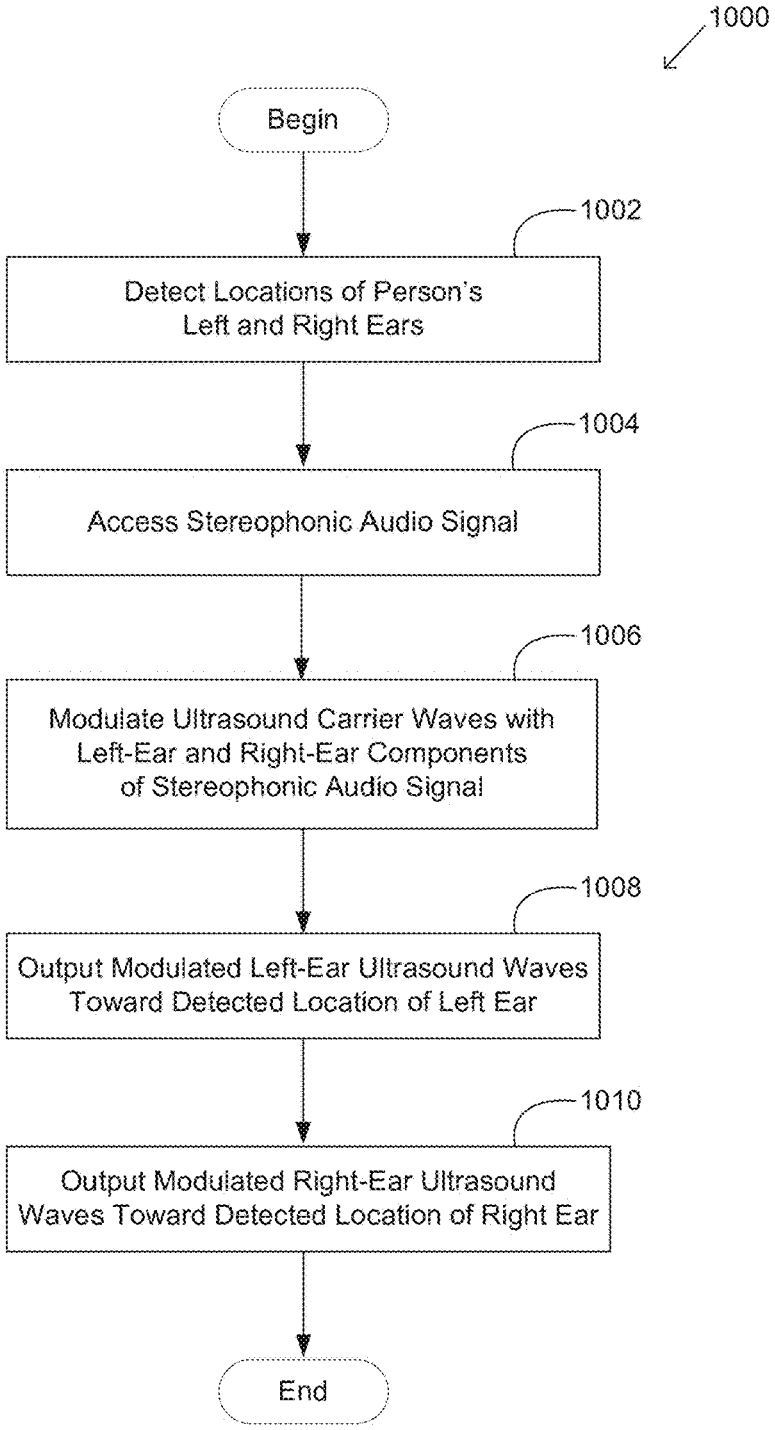
FIG. 10 is a flowchart illustrating an exemplary method of operation of an audio content delivery system in accordance with some embodiments.

It should be appreciated from the foregoing that another embodiment is directed to a method 1000 for providing stereophonic sound using a plurality of ultrasound emitters, as illustrated in FIG. 10. Method 1000 begins at act 1002, at which a location of a person's left ear and a location of the person's right ear may be detected with at least one sensor. For example, the sensor(s) may comprise one or more cameras, and the camera(s) may be configured to capture an image of a person in proximity to the audio content delivery system. The captured image may be processed to detect the location of the person's ears by detecting the presence of a head, a face, or any other suitable part of a person's body, from which the locations of the person's ears may be directly detected and/or inferred. The detected locations of the person's ears may be stored in a memory.

At act 1004, a stereophonic audio signal having at least a left-ear component signal and a right-ear component signal in an audible frequency range may be accessed by a controller of the audio content delivery system. For example, controller 802 may obtain the stereophonic audio signal from a memory device.

At act 1006, separate ultrasound carrier waves may be modulated with the left-ear and right-ear components of the stereophonic audio signal. The ultrasound carrier waves may be generated using an ultrasound carrier generator, such as an oscillator, an astable circuit, or any other suitable type of generator, and may be amplitude-modulated, in some embodiments, with the corresponding single-ear component of the stereophonic audio signal.

At act 1008, the modulated left-ear ultrasound waves may be output toward the detected location of the person's left ear via one or more left-ear ultrasound emitters. For example, the controller may access the detected location of the person's left ear from a memory device, and may execute a routine that, based on the detected location, outputs one or more control signals. The controller may use the control signal(s) to drive the left-ear ultrasound emitters to direct the left-ear component of the stereophonic audio signal to the person's left ear via the left-ear ultrasound carrier.

At act 1010, the modulated right-ear ultrasound waves may be output toward the detected location of the person's right ear via one or more right-ear ultrasound emitters. For example, the controller may access the detected location of the person's right ear from a memory device, and may execute a routine that, based on the detected location, outputs one or more control signals. The controller may use the control signal(s) to drive the right-ear ultrasound emitters to direct the right-ear component of the stereophonic audio signal to the person's right ear via the right-ear ultrasound carrier. Acts 1008 and 1010 may occur concurrently in some embodiments.

Figure 11:
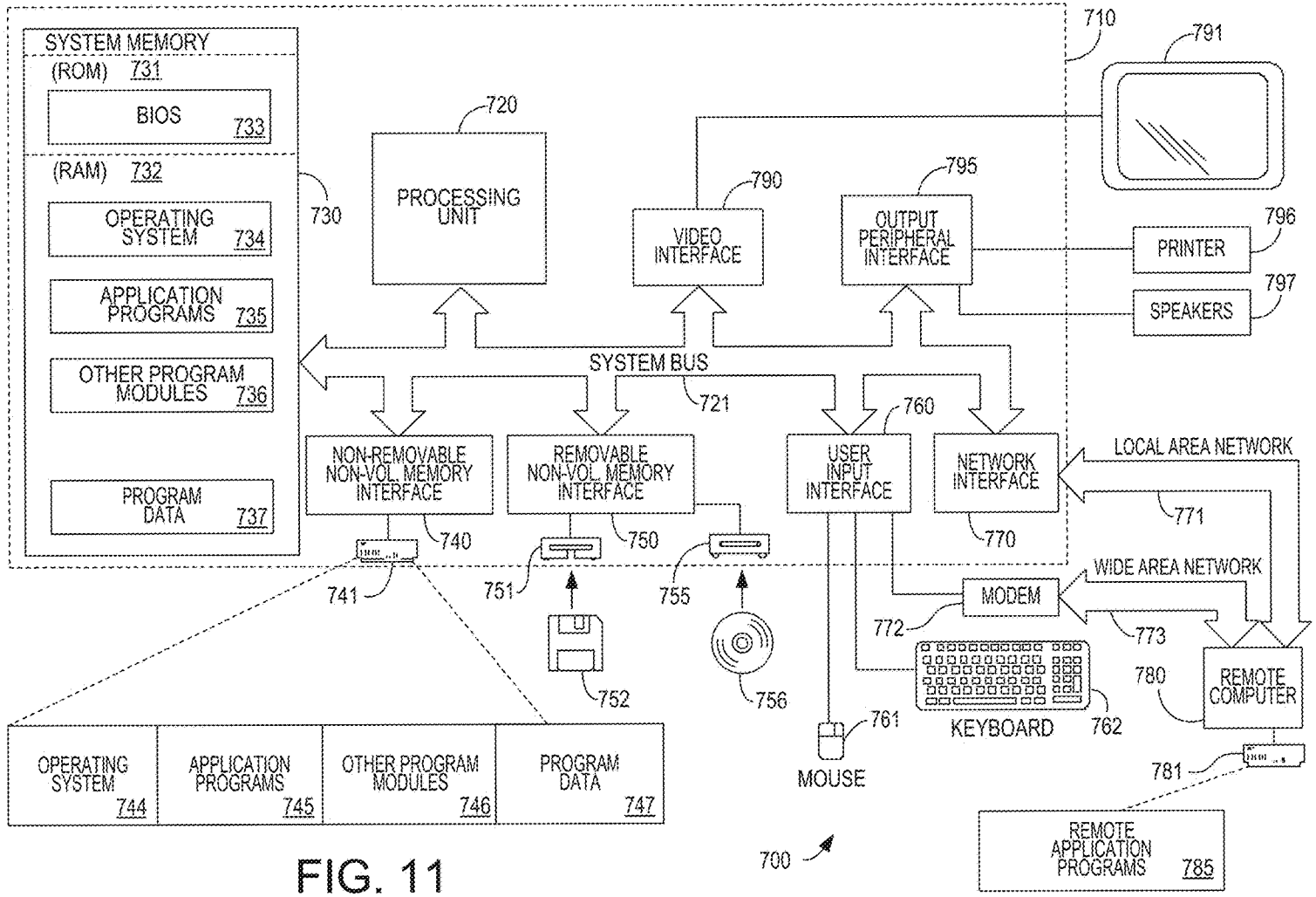
FIG. 11 is a schematic diagram of an exemplary computing environment in which some embodiments may be implemented.

FIG. 11 illustrates an example of a suitable computing system environment 700 in which some embodiments may be implemented. However, it should be appreciated that the computing system environment 700 is only one example of a suitable computing environment and is not intended to suggest any limitation as to the scope of use or functionality of the described embodiments. Neither should the computing environment 700 be interpreted as having any dependency or requirement relating to any one or combination of components illustrated in the exemplary operating environment 700. For example, some embodiments of a computing system usable with techniques described herein may include more or fewer components than illustrated in the example of FIG. 11.

Embodiments are operational with numerous other computing system environments or configurations. Examples of well-known computing systems, environments, and/or configurations that may be suitable for use with the described techniques include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

The computing environment may execute computer-executable instructions, such as program modules. Generally, program modules include routines, programs, objects, components, data structures, etc., that perform particular tasks or implement particular abstract data types. The embodiments may also be practiced in distributed computing environments where tasks are performed by remote processing devices that are linked through a communications network. In a distributed computing environment, program modules may be located in both local and remote computer storage media including memory storage devices.

With reference to FIG. 11, an exemplary system for implementing the described techniques includes a computing device in the form of a computer 710. Components of computer 710 may include, but are not limited to, a processing unit 720, a system memory 730, and a system bus 721 that couples various system components including the system memory to the processing unit 720. The system bus 721 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 710 typically includes a variety of computer readable media. Computer readable media can be any available media that can be accessed by computer 710 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can accessed by computer 710. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer readable media.

The system memory 730 includes computer storage media in the form of volatile and/or nonvolatile memory such as read only memory (ROM) 731 and random access memory (RAM) 732. A basic input/output system 733 (BIOS), containing the basic routines that help to transfer information between elements within computer 710, such as during start-up, is typically stored in ROM 731. RAM 732 typically contains data and/or program modules that are immediately accessible to and/or presently being operated on by processing unit 720. By way of example, and not limitation, FIG. 11 illustrates operating system 734, application programs 735, other program modules 736, and program data 737.

The computer 710 may also include other removable/non-removable, volatile/nonvolatile computer storage media. By way of example only, FIG. 11 illustrates a hard disk drive 741 that reads from or writes to non-removable, nonvolatile magnetic media, a magnetic disk drive 751 that reads from or writes to a removable, nonvolatile magnetic disk 752, and an optical disk drive 755 that reads from or writes to a removable, nonvolatile optical disk 756 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 741 is typically connected to the system bus 721 through a non-removable memory interface such as interface 740, and magnetic disk drive 751 and optical disk drive 755 are typically connected to the system bus 721 by a removable memory interface, such as interface 750.

The drives and their associated computer storage media discussed above and illustrated in FIG. 11 provide storage of computer readable instructions, data structures, program modules and other data for the computer 710. In FIG. 11, for example, hard disk drive 741 is illustrated as storing operating system 744, application programs 745, other program modules 746, and program data 747. Note that these components can either be the same as or different from operating system 734, application programs 735, other program modules 736, and program data 737. Operating system 744, application programs 745, other program modules 746, and program data 747 are given different numbers here to illustrate that, at a minimum, they are different copies. A user may enter commands and information into the computer 710 through input devices such as a keyboard 762 and pointing device 761, commonly referred to as a mouse, trackball or touch pad. Other input devices (not shown) may include a microphone, joystick, game pad, satellite dish, scanner, touchscreen, or the like. These and other input devices are often connected to the processing unit 720 through a user input interface 760 that is coupled to the system bus, but may be connected by other interface and bus structures, such as a parallel port, game port or a universal serial bus (USB). A monitor 791 or other type of display device is also connected to the system bus 721 via an interface, such as a video interface 790. In addition to the monitor, computers may also include other peripheral output devices such as speakers 797 and printer 796, which may be connected through an output peripheral interface 795.

The computer 710 may operate in a networked environment using logical connections to one or more remote computers, such as a remote computer 780. The remote computer 780 may be a personal computer, a server, a router, a network PC, a peer device or other common network node, and typically includes many or all of the elements described above relative to the computer 710, although only a memory storage device 781 has been illustrated in FIG. 11. The logical connections depicted in FIG. 11 include a local area network (LAN) 771 and a wide area network (WAN) 773, but may also include other networks. Such networking environments are commonplace in offices, enterprise-wide computer networks, intranets and the Internet.

When used in a LAN networking environment, the computer 710 is connected to the LAN 771 through a network interface or adapter 770. When used in a WAN networking environment, the computer 710 typically includes a modem 772 or other means for establishing communications over the WAN 773, such as the Internet. The modem 772, which may be internal or external, may be connected to the system bus 721 via the user input interface 760, or other appropriate mechanism. In a networked environment, program modules depicted relative to the computer 710, or portions thereof, may be stored in the remote memory storage device. By way of example, and not limitation, FIG. 11 illustrates remote application programs 785 as residing on memory device 781. It will be appreciated that the network connections shown are exemplary and other means of establishing a communications link between the computers may be used.

The above-described embodiments can be implemented in any of numerous ways. For example, the embodiments may be implemented using hardware, software or a combination thereof. When implemented in software, the software code can be executed on any suitable processor or collection of processors, whether provided in a single computer or distributed among multiple computers. It should be appreciated that any component or collection of components that perform the functions described above can be generically considered as one or more controllers that control the above-discussed functions. The one or more controllers can be implemented in numerous ways, such as with dedicated hardware, or with non-dedicated hardware (e.g., one or more processors) that is programmed using microcode or software to perform the functions recited above.

In this respect, it should be appreciated that one implementation comprises at least one processor-readable storage medium (i.e., at least one tangible, non-transitory processor-readable medium, e.g., a computer memory (e.g., hard drive, flash memory, processor working memory, etc.), a floppy disk, an optical disc, a magnetic tape, or other tangible, non-transitory processor-readable medium) encoded with a computer program (i.e., a plurality of instructions), which, when executed on one or more processors, performs at least the above-discussed functions. The processor-readable storage medium can be transportable such that the program stored thereon can be loaded onto any computer resource to implement functionality discussed herein. In addition, it should be appreciated that the reference to a computer program which, when executed, performs above-discussed functions, is not limited to an application program running on a host computer. Rather, the term "computer program" is used herein in a generic sense to reference any type of computer code (e.g., software or microcode) that can be employed to program one or more processors to implement above-discussed functionality.

The phraseology and terminology used herein is for the purpose of description and should not be regarded as limiting. The use of "including," "comprising," "having," "containing," "involving," and variations thereof, is meant to encompass the items listed thereafter and additional items. Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements.

Having described several embodiments, various modifications and improvements will readily occur to those skilled in the art. Such modifications and improvements are intended to be within the spirit and scope of the invention. Accordingly, the foregoing description is by way of example only, and is not intended as limiting. The invention is limited only as defined by the following claims and the equivalents thereto.

What is claimed is:

1. An electronic gaming machine system comprising:

a display;

one or more input controls;

one or more audio speakers;

one or more ultrasound emitters, wherein at least one of the one or more ultrasound emitters comprises a plurality of ultrasound transducers arranged in a linear array of ultrasound transducers;

at least one sensor configured to detect a location of a head of a person in proximity to the display and, in response to detecting the location of the person's head, generate a first signal indicative of the location of the person's head; and control circuitry configured to:

execute wagering game software that receives input commands entered via the one or more input controls;

display graphics output from the wagering game software responsive to the input commands;

generate one or more private sound signals in an audible frequency range, and one or more public sound signals in the audible frequency range;

determine the location of the person's head based on the first signal generated by the at least one sensor;

based on the determined location of the person's head, direct the one or more private sound signals to the location of the person's head by modulating one or more ultrasound carrier waves with the one or more private sound signals and outputting the modulated ultrasound waves toward the location of the person's head via the one or more ultrasound emitters, wherein the control circuitry is further configured to direct modulated ultrasound waves emitted by the at least one of the one or more ultrasound emitters comprising the linear array of ultrasound transducers toward different locations by selectively driving a first subset of the ultrasound transducers of the linear array of ultrasound transducers; and play the one or more public sound signals in the audible frequency range via the one or more audio speakers.

2. The electronic gaming machine system of claim 1, wherein generating the one or more private sound signals comprises generating one or more audio instructions and designating the one or more audio instructions as private sounds.

3. The electronic gaming machine system of claim 1, wherein generating the one or more private sound signals comprises generating one or more menu sounds and designating the one or more menu sounds as private sounds.

4. The electronic gaming machine system of claim 1, wherein generating the one or more private sound signals comprises generating one or more attract mode sounds and designating the one or more attract mode sounds as private sounds.

5. The electronic gaming machine system of claim 4, wherein the control circuitry is further configured to:

determine via the at least one sensor that the person is in proximity to the display;

in response to determining via the at least one sensor that the person is in proximity to the display, modulate the one or more ultrasound carrier waves with the one or more attract mode sounds and output the modulated ultrasound waves toward the determined location of the person's head via the one or more ultrasound emitters; and in response to determining that the person is no longer in proximity to the display, stop outputting the ultrasound waves modulated with the one or more attract mode sounds.

6. The electronic gaming machine system of claim 1, wherein generating the one or more public sound signals comprises generating one or more win acknowledgment sounds and designating the one or more win acknowledgment sounds as public sounds.

7. The electronic gaming machine system of claim 1, wherein the one or more ultrasound emitters comprise at least one electrostatic ultrasound speaker.

8. The electronic gaming machine system of claim 1, wherein the control circuitry is further configured to:

in response to detecting a change in the location of the person's head in proximity to the display, selectively drive a second subset of the ultrasound transducers in the linear array to redirect the modulated ultrasound waves toward the new location of the person's head, wherein the second subset of the ultrasound transducers is different than the first subset of the ultrasound transducers.

9. The electronic gaming machine system of claim 1, wherein the one or more ultrasound carrier waves are in a frequency range between about 30 KHz and about 50 KHz.

10. The electronic gaming machine system of claim 1, wherein the at least one sensor comprises a camera that is configured to detect the location of the person by capturing an image showing the person in the location in proximity to the display.

11. The electronic gaming machine system of claim 1, wherein the at least one sensor comprises at least one ultrasound sensor that is configured to detect the location of the person by detecting an ultrasound wave reflected by the person.

12. The electronic gaming machine system of claim 1, further comprising at least one audio sensor, wherein the control circuitry is further configured to adjust an amplitude of the output ultrasound carrier waves modulated with the one or more private sound signals based at least in part on a level of background noise detected via the at least one audio sensor.

13. The electronic gaming machine system of claim 1, wherein:

the one or more ultrasound emitters comprise one or more left-ear ultrasound emitters and one or more right-ear ultrasound emitters;

the at least one sensor is configured to detect a location of the person's left ear and a location of the person's right ear and, in response to detecting the location of the person's left ear and the location of the person's right ear, generate a second signal indicative of the location of the person's left ear and the location of the person's right ear; and the control circuitry is configured to:

access a stereophonic audio signal having at least a left-ear component signal and a right-ear component signal in the audible frequency range;

determine the location of the person's head based on the second signal generated by the at least one sensor;

direct the left-ear component of the stereophonic audio signal to the determined location of the person's left ear based on the determined location of the person's left ear by modulating one or more left-ear ultrasound carrier waves with the left-ear component of the stereophonic audio signal and selectively driving a second subset of the ultrasound transducers in the linear array to output the modulated left-ear ultrasound waves toward the determined location of the person's left ear via the one or more left-ear ultrasound emitters; and direct the right-ear component of the stereophonic audio signal to the determined location of the person's right ear based on the detected location of the person's right ear by modulating one or more right-ear ultrasound carrier waves with the right-ear component of the stereophonic audio signal and selectively driving a third subset of the ultrasound transducers in the linear array to output the modulated right-ear ultrasound waves toward the determined location of the person's right ear via the one or more right-ear ultrasound emitters.

14. The electronic gaming machine system of claim 13, wherein the control circuitry is further configured to:

in response to detecting a change in the person's left ear location and/or in the person's right ear location, selectively drive a fourth subset of the ultrasound transducers in the linear array to redirect the modulated left-ear ultrasound waves toward the person's new left ear location and/or the modulated right-ear ultrasound waves toward the person's new right ear location.

15. The electronic gaming machine system of claim 1, further comprising one or more low-frequency vibration-generating devices coupled to a seat of the electronic gaming machine system, wherein the control circuitry is further configured to:

generate one or more low-frequency sound signals in a lower frequency range than the audible frequency range of the one or more private sound signals output via the modulated ultrasound waves, and output the one or more low-frequency sound signals via the one or more low-frequency vibration-generating devices.

16. The electronic gaming machine system of claim 1, wherein the person is a first person, the one or more ultrasound emitters are first one or more ultrasound emitters, the one or more private sound signals are first one or more private signals, the one or more ultrasound carrier waves are first one or more ultrasound carrier waves;

the electronic gaming machine system further comprises second one or more ultrasound emitters; and wherein the control circuitry is further configured to:

execute multi-player wagering game software;

generate second one or more private sound signals in the audible frequency range; and direct the second one or more private sound signals toward a second person by modulating second ultrasound carrier wave with the second one or more private sound signals and outputting the second modulated ultrasound carrier waves toward the second person via the second one or more ultrasound emitters.

17. The electronic gaming machine system of claim 1, wherein selectively driving the first subset of the ultrasound transducers of the linear array of ultrasound transducers comprises adjusting a phase of at least one of a plurality of signals driving the first subset of the ultrasound transducers of the linear array of ultrasound transducers.

18. The system of claim 1, wherein the linear array of ultrasound transducers of the at least one of the one or more ultrasound emitters comprises a plurality of linear arrays of ultrasound transducers arranged in a two-dimensional array of ultrasound transducers.

19. An electronic gaming machine system comprising:

a display;

one or more input controls;

one or more ultrasound emitters, wherein at least one of the one or more ultrasound emitters comprises a plurality of ultrasound transducers arranged in a linear array;

at least one sensor configured to detect a location of head of a person in proximity to the display and, in response to detecting the location of the person's head, generate a first signal indicative of the location of the person's head; and control circuitry configured to:

execute wagering game software that receives input commands entered via the one or more input controls;

display graphics output from the wagering game software responsive to the input commands;

generate one or more private sound signals in an audible frequency range;

determine the location of the person's head based on the first signal generated by the at least one sensor;

based on the determined location of the person's head, direct the one or more private sound signals to the location of the person's head by modulating one or more ultrasound carrier waves with the one or more private sound signals and outputting the modulated ultrasound waves toward the location of the person's head via the one or more ultrasound emitters, wherein the control circuitry is further configured to direct modulated ultrasound waves emitted by the at least one of the one or more ultrasound emitters comprising the linear array of ultrasound transducers toward different locations by selectively driving a first subset of the ultrasound transducers of the linear array of ultrasound transducers.

20. An audio content delivery system comprising:

a plurality of ultrasound emitters, including one or more left-ear ultrasound emitters and one or more right-ear ultrasound emitters, wherein at least one of the one or more ultrasound emitters comprises a plurality of ultrasound transducers arranged in a linear array;

at least one sensor configured to detect a location of a person's left ear and a location of the person's right ear and, in response to detecting the location of the person's left ear and the location of the person's right ear, generate a first signal indicative of the location of the person's left ear and the location of the person's right ear; and control circuitry configured to:

access a stereophonic audio signal having at least a left-ear component signal and a right-ear component signal in an audible frequency range;

determine the location of the person's head based on the first signal generated by the at least one sensor;

direct the left-ear component of the stereophonic audio signal to the determined location of the person's left ear by modulating one or more left-ear ultrasound carrier waves with the left-ear component of the stereophonic audio signal and outputting the modulated left-ear ultrasound waves toward the determined location of the person's left ear via the one or more left-ear ultrasound emitters; and direct the right-ear component of the stereophonic audio signal to the determined location of the person's right ear by modulating one or more right-ear ultrasound carrier waves with the right-ear component of the stereophonic audio signal and outputting the modulated right-ear ultrasound waves toward the determined location of the person's right ear via the one or more right-ear ultrasound emitters;

wherein the control circuitry is further configured to direct modulated ultrasound waves emitted by the at least one of the one or more ultrasound emitters comprising the plurality of ultrasound transducers toward different locations by selectively driving a first subset of the ultrasound transducers of the linear array of ultrasound transducers.

* * * * *